US011380972B2

(12) United States Patent
Ghiotto et al.

(10) Patent No.: US 11,380,972 B2
(45) Date of Patent: Jul. 5, 2022

(54) MICROWAVE WAVEGUIDE COMPRISING A CAVITY FORMED BY LAYERS HAVING CONDUCTIVE SURFACES AND A DIELECTRIC STRIP DISPOSED IN THE CAVITY

(71) Applicants: UNIVERSITÉ DE BORDEAUX, Bordeaux (FR); CENTRE NATIONAL D'ETUDES SPATIALES, Paris (FR); INSTITUT POLYTECHNIQUE DE BORDEAUX, Talence (FR); CENTRE NATIONAL DE LA RECHERCHE SCIENTIFIQUE, Paris (FR)

(72) Inventors: Anthony Ghiotto, Begles (FR); Frédéric Parment, Ramonville-St-Agne (FR)

(73) Assignees: UNIVERSITÉ DE BORDEAUX, Bordeaux (FR); INSTITUT POLYTECHNIQUE DE BORDEAUX, Talence (FR); CENTRE NATIONAL DE LA RECHERCHE SCIENTIFIQUE, Paris (FR); CENTRE NATIONAL D'ETUDES SPATIALES, Paris (FR)

( * ) Notice: Subject to any disclaimer, the term of this patent is extended or adjusted under 35 U.S.C. 154(b) by 0 days.

(21) Appl. No.: 16/768,917

(22) PCT Filed: Dec. 5, 2018

(86) PCT No.: PCT/EP2018/083625
§ 371 (c)(1),
(2) Date: Jun. 2, 2020

(87) PCT Pub. No.: WO2019/110651
PCT Pub. Date: Jun. 13, 2019

(65) Prior Publication Data

US 2021/0151846 A1 May 20, 2021

(30) Foreign Application Priority Data

Dec. 5, 2017 (FR) ..... 1761661

(51) Int. Cl.
*H01P 3/12* (2006.01)
*H01P 11/00* (2006.01)

(52) U.S. Cl.
CPC ..... *H01P 3/122* (2013.01); *H01P 3/121* (2013.01); *H01P 11/002* (2013.01)

(58) Field of Classification Search
CPC .. H01P 3/122; H01P 3/121; H01P 3/12; H01P 3/165; H01P 11/002; H01P 11/006
(Continued)

(56) References Cited

U.S. PATENT DOCUMENTS 4,970,522 A * 11/1990 Niman ..... H01Q 21/064 333/237
5,528,208 A * 6/1996 Kobayashi ..... H01P 3/14 333/241

(Continued)

OTHER PUBLICATIONS

International Search Report in connection with International Patent Application No. PCT/EP2018/083625, dated Dec. 5, 2019, 5 pages.

(Continued)

*Primary Examiner* — Benny T Lee
(74) *Attorney, Agent, or Firm* — Duane Morris LLP

(57) ABSTRACT

This microwave component (10) comprises a waveguide (12) comprising an upper layer, a lower layer, and a central layer (18) intermediate between the upper layer and the lower layer, said layers defining a zone (19) of propagation of an electromagnetic wave, the propagation zone (19) extending along a propagation axis, and comprising a cavity (32) bounded by the upper layer, the lower layer, and, laterally, by two opposite lateral edges (36) of the central layer (18).

(Continued)

The waveguide (12) comprises at least one dielectric strip (28) placed in the propagation zone (19), the dielectric strip (28) being defined in one of the upper layer and the lower layer or being placed in the cavity (32) away from the lateral edges (36) of the cavity (32).

18 Claims, 8 Drawing Sheets

(58) Field of Classification Search
USPC ..... 333/248
See application file for complete search history.

(56) References Cited

U.S. PATENT DOCUMENTS

| | | | | |
|---|---|---|---|---|
| 6,362,696 | B1 * | 3/2002 | Ishikawa et al. ..... | H01P 3/165 331/107 G |
| 2002/0093403 | A1 | 7/2002 | Saitoh et al. | |
| 2004/0041663 | A1 | 3/2004 | Uchimura et al. | |

OTHER PUBLICATIONS

Israel Boudreau et al: "Broadband phase shifter using air holes in Substrate Integrated Waveguide", Microwave Symposium Digest (MTT), 2011 IEEE MTT-S International, IEEE, Jun. 5, 2011, pp. 1-4.

Parment Frederic et al: "Double Dielectric Slab-Loaded Air-Filled SIW Phase Shifters for High-Performance Millimeter-Wave Integration", IEEE Transactions on Microwave Theory and Techniques, Plenum, USA,vol. 64, No. 9, Sep. 1, 2016.

W.E. Hord et al: "Approximation Technique for Dielectric Loaded Waveguides", IEEE Transactions on Microwave Theory and Techniques, vol. 16, No. 4, Apr. 1, 1968, pp. 228-233.

Deslandes D et al: "Substrate integrated slab waveguide (SISW) for wideband microwave applications", 2003 IEEE MTT-S International Microwave Symposium Digest.(IM S 2003). Philadelphia, PA, Jun. 8-13, 2003; [IEEE MTT-S International Microwave Symposium]. New York, NY : IEEE, US, Jun. 8, 2003 (Jun. 8, 2003), p. 1103.

* cited by examiner

MICROWAVE WAVEGUIDE COMPRISING A CAVITY FORMED BY LAYERS HAVING CONDUCTIVE SURFACES AND A DIELECTRIC STRIP DISPOSED IN THE CAVITY

CROSS REFERENCE TO RELATED APPLICATIONS

This application is a U.S. national stage application under 35 U.S.C. § 371 of International Application No. PCT/EP2018/083625, filed Dec. 5, 2018 which claims priority to French patent application no. 1761661, filed Dec. 5, 2017, the entireties of which are incorporated herein by reference.

FIELD OF THE INVENTION

The present invention relates to a microwave component including a wave guide comprising at least one upper layer having at least one electrically conductive surface, a lower layer having at least one electrically conductive surface, and a central layer intermediate between the upper layer and the lower layer, the layers defining a zone of propagation for an electromagnetic wave, the propagation zone extending along a propagation axis, and comprising a cavity, the cavity being bounded by the upper layer, the lower layer, and, laterally, by two opposite lateral edges of the central layer.

BACKGROUND OF THE INVENTION

At this time, one major issue in the telecom industry, in particular for 5G base stations, the millimetric radar industry for drones, autonomous cars, and more generally for any type of robot, is reducing losses in the systems drastically, at a time where energy savings are essential for future applications. These loss levels are indeed prohibitive for equipment items such as upstream equipment of a transceiver antenna (equipment of the "front-end RF" type).

To reduce losses, it is known to design passive electronic structures by using air-filled substrate integrated waveguide or empty substrate integrated waveguide (AFSIW or ESIW) technology. The passive structure then forms a microwave transmission line.

However, for some applications, the bandwidth offered by such structures is not fully satisfactory.

One aim of the invention is therefore to manufacture and provide, at low costs, a microwave component suitable for working in the millimetric wavelength domain, the component having a good bandwidth and low losses.

To that end, the invention relates to a microwave component of the aforementioned type, wherein the waveguide comprises at least one dielectric strip placed in the propagation zone, the dielectric strip being defined in one of the upper layer and the lower layer or being placed in the cavity away from the lateral edges of the cavity.

SUMMARY OF THE INVENTION

The component according to the invention may comprise one or more of the following features, considered alone or according to any technically possible combination(s):

- the dielectric strip extends along a longitudinal direction parallel to the propagation axis, and is centered on a median plane of the two lateral edges or is laterally offset from the median plane of the two lateral edges;
- the dielectric strip is placed in the cavity separated from the lateral edges of the cavity, the waveguide comprising a functional attachment component, the functional attachment component being formed by a plurality of dielectric fasteners integral with the dielectric strip, each dielectric fastener extending from one of the lateral edges, the dielectric fasteners being configured to perform a filter function for an electromagnetic wave propagating in the propagation zone;
- each dielectric fastener is in the form of a rectilinear bar and extends from one of the lateral edges;
- the dielectric strip is placed in the cavity separated from the lateral edges of the cavity, the central layer comprising at least one dielectric sublayer, the cavity being defined along the propagation axis between a front end and a rear end of the central layer, the dielectric strip extending from the front end to the rear end and being integral with the dielectric sublayer of the central layer;
- the dielectric strip is placed in the cavity separated from the lateral edges of the cavity, the dielectric strip being a first dielectric strip, the waveguide further comprising a second dielectric strip, the second dielectric strip being placed in the cavity, separated from the first dielectric strip, and separated from the lateral edges of the cavity;
- the dielectric strip is defined in one of the upper layer and the lower layer, the dielectric strip having a surface defining the cavity;
- the dielectric strip is a first dielectric strip, the waveguide further comprising a second dielectric strip placed in the propagation zone, the second dielectric strip being delimited in one of the upper layer and the lower layer, separated from the first dielectric strip, and having a surface defining the cavity;
- the waveguide further comprises another dielectric strip, the other dielectric strip being positioned in the cavity, separated from the lateral edges of the cavity;
- the dielectric strip is formed in a dielectric sublayer of one of the upper layer and the lower layer, and is defined by a part of an electrically conductive sublayer of the layer, and laterally between two lateral borders; and
- the cavity is filled with a fluid having a dielectric constant, or defines a sealed closed volume and is empty of fluid.

The invention also relates to a process for manufacturing a microwave component comprising the following steps:

- providing an upper layer and a lower layer respectively having at least one electrically conductive surface;
- providing a central layer having one or several recess(es), the recess or the plurality of recesses being intended to form a cavity defined laterally by opposite lateral edges formed by the central layer; then
- assembling the layers such that the central layer is intermediate between the upper layer and the lower layer, the layers defining a zone of propagation for an electromagnetic wave, the propagation zone extending along a propagation axis, and comprising a cavity, the cavity being formed by the recess or the plurality of recesses while being bounded by the upper layer, the lower layer, and, laterally, by the lateral edges of the central layer;

the step for providing at least one of the layers comprising producing a dielectric strip, the dielectric strip being placed in the layer, such that after the assembly step, the dielectric strip is placed in the propagation zone and is defined in one of the upper layer and the lower layer, or such that after the assembly step, the dielectric strip is placed in the propagation zone and in the cavity separated from the lateral edges of the cavity.

The manufacturing process according to the invention may comprise one or more of the following features, considered alone or according to any technically possible combination(s):

the step for providing the central layer comprises producing the dielectric strip, the dielectric strip being placed in the central layer, such that after the assembly step, the dielectric strip is placed in the propagation zone and in the cavity separated from the lateral edges of the cavity, the dielectric strip being placed between a plane defined by an upper surface of the central layer and a plane defined by a lower surface of the central layer;

the step for providing the central layer comprises:

providing an initial layer, the initial layer being intended to form the central layer, comprising at least one initial dielectric sublayer and being devoid of recess, cutting, in the initial layer, the plurality of recesses intended to form the cavity, the step for producing the dielectric strip being carried out during the cutting of the plurality of recesses, the plurality of cut recesses defining the dielectric strip, the dielectric strip having a length, taken along the propagation axis, equal to the length of the cavity, taken along the propagation axis;

the step for providing the central layer comprises:

providing an initial layer, the initial layer being intended to form the central layer, comprising at least one initial dielectric sublayer and being devoid of recess, cutting, in the initial layer, the plurality of recesses intended to form the cavity, the step for producing the dielectric strip being carried out during the cutting of the plurality of recesses, the plurality of cut recesses being intended to define the cavity, and defining the dielectric strip and attachment means of the dielectric strip, the attachment means comprising a plurality of dielectric fasteners coupling the dielectric strip to at least one of the lateral edges;

the step for producing the dielectric strip comprises providing a dielectric strip and attachment means of the dielectric strip, the attachment means comprising a plurality of dielectric fasteners secured to the dielectric strip, the dielectric strip and the attachment means being provided separated from the central layer;

the assembly step of the layers comprises attaching the central layer to the lower layer, then removing the attachment means, by cutting the attached means, once the central layer is attached to the lower layer;

the step for providing one of the upper layer and the lower layer comprising producing the dielectric strip, the dielectric strip being placed in the layer, such that after the assembly step, the dielectric strip is placed in the propagation zone and is defined in the layer;

the median plane of the lateral edges of the cavity forms a plane of symmetry of the assembly formed by the dielectric fasteners;

the dielectric fasteners only extend from a single one of the lateral edges;

each dielectric fastener is in the form of a rectilinear bar and extends from one of the lateral edges;

at least part of the attachment means is not removed during the assembly step of the layers, the part of the attachment means then forming a functional attachment component, the dielectric fasteners that are not removed being configured to perform a filter function for an electromagnetic wave propagating in the propagation zone;

the process comprises a step for supplying the microwave component with an electromagnetic wave propagating in the propagation zone, the electromagnetic wave having at least one propagation mode having two electric field maximums, the or each dielectric strip being located in the cavity at one of the maximums;

the dielectric strip is a first dielectric strip, the manufacturing step being a step for manufacturing the first dielectric strip and a second dielectric strip, the step for manufacturing the first dielectric strip and the second dielectric strip being carried out during the cutting of the plurality of recesses; the plurality of cut recesses defining the first dielectric strip, the second dielectric strip and attachment means of the first dielectric strip and the second dielectric strip; the attachment means comprising a plurality of first dielectric fasteners coupling the first dielectric strip to one of the lateral edges and a plurality of second dielectric fasteners coupling the second dielectric strip to the other of the lateral edges;

after assembly, the dielectric strip has a surface defining the cavity;

the step for providing one of the upper layer and the lower layer comprises providing an initial layer, the initial layer being intended to form the layer and comprising at least one dielectric sublayer, an electrically conductive upper sublayer, and an electrically conductive lower sublayer; the manufacture of the dielectric strip comprising the implementation of lateral borders in the initial layer and the elimination of at least part of one of the electrically conductive sublayers of the initial layer extending between the two lateral borders;

the dielectric strip is a first dielectric strip, a step for providing the upper layer or the lower layer comprising producing a second dielectric strip; and after assembly, the cavity is filled with a fluid having a dielectric constant, or defines a sealed closed volume and is empty of fluid.

BRIEF DESCRIPTION OF THE DRAWINGS

The invention will be better understood upon reading the following description, provided solely as an example, and in reference to the appended drawings, in which.

It is noted that like reference numbers and designations in the various drawings and in the specification descriptions indicate like elements.

DETAILED DESCRIPTION OF THE PREFERRED EMBODIMENTS

Figure 1:
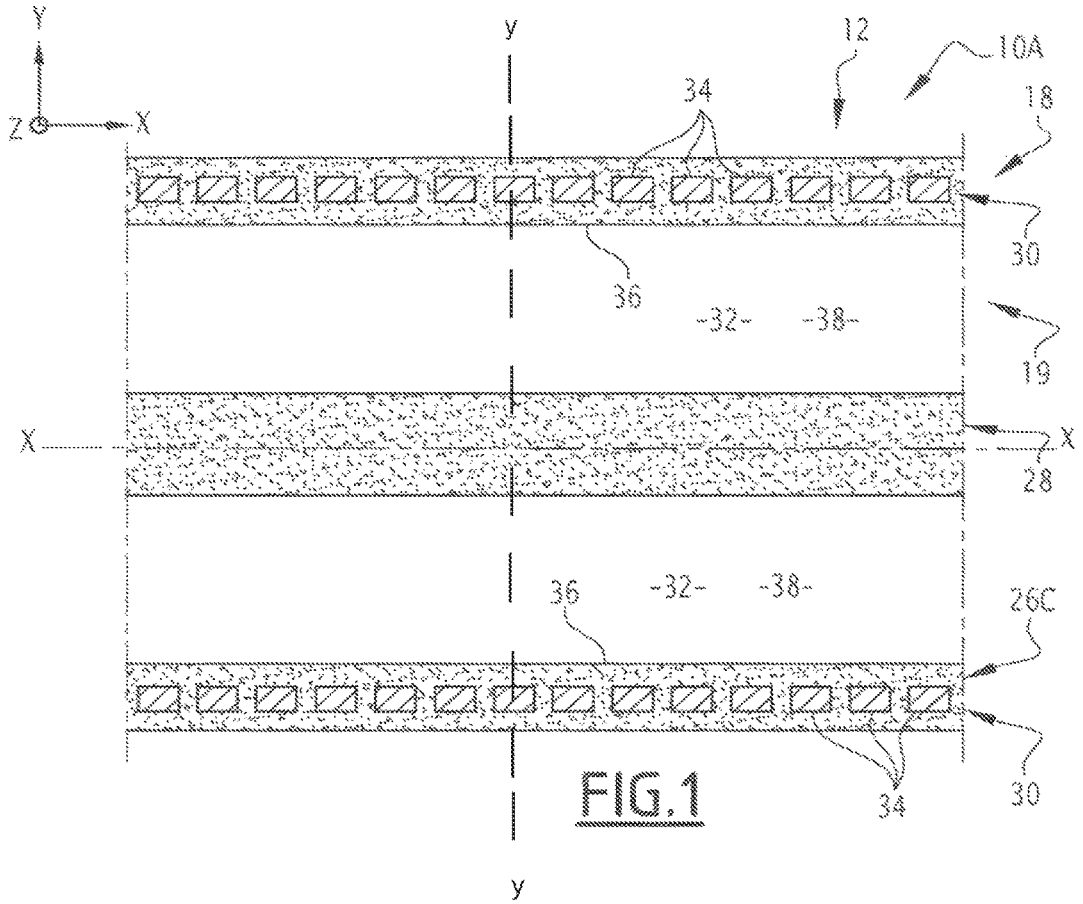
FIG. 1 is a top schematic sectional view of a first microwave component according to the invention, the section passing through the dielectric strip.
Figure 2:
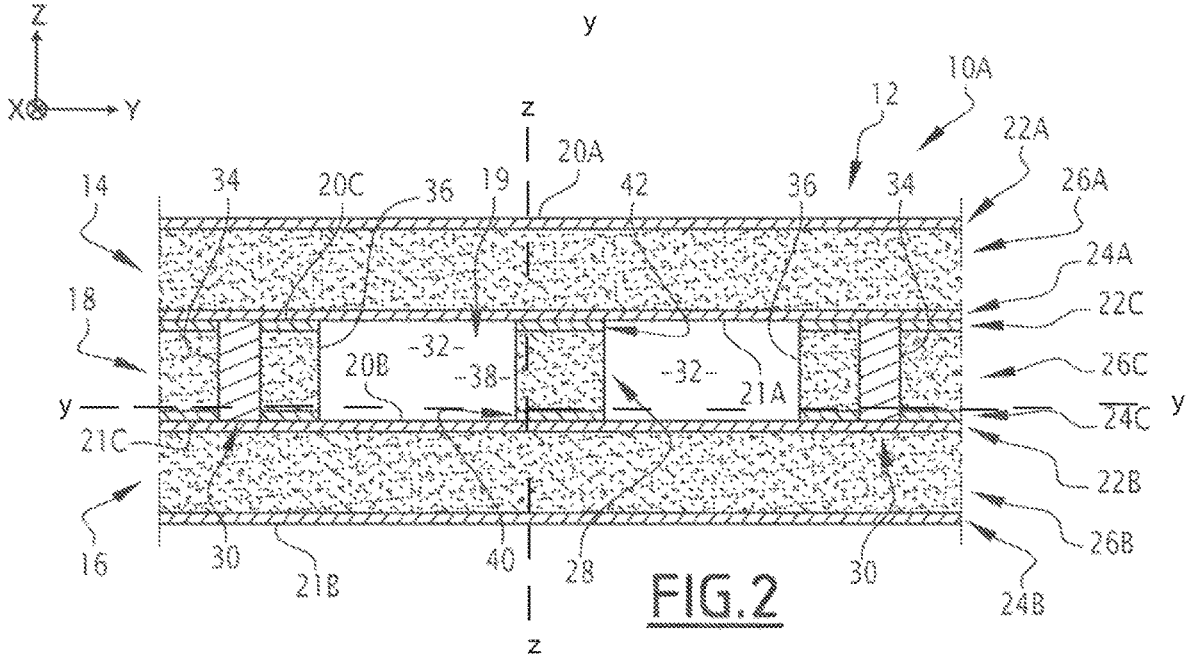
FIG. 2 is a schematic cross-sectional view of the first component of FIG. 1.

A first microwave component 10A according to the invention is illustrated in FIGS. 1 and 2.

The first component 10A is for example a filter, in particular a bandpass, low-pass, high-pass or notch filter. In a variant, the first microwave component 10A is for example a transmission line, a multiplexer, a coupler, a divider, a combiner, an antenna, an oscillator, an amplifier, a circulator, a resonator, a phase shifter or an isolator.

The first component 10A here is of the type "with guide integrated into the substrate".

The first component 10A includes a waveguide 12 capable of guiding an electromagnetic wave along a propagation axis X-X illustrated in FIG. 1, the electromagnetic wave in particular having a wavelength greater than or equal to a predetermined minimum wavelength.

The waveguide 12 comprises an upper layer 14, a lower layer 16, and a central layer 18 intermediate between the upper layer 14 and the lower layer 16, the layers 14, 16, 18 defining a propagation zone 19 of the electromagnetic wave, the propagation zone 19 extending along the propagation axis X-X illustrated in FIG. 1.

The waveguide 12 further comprises at least one dielectric strip 28 placed in the propagation zone 19.

Hereinafter, "dielectric element" means that the element has a relative dielectric permittivity greater than or equal to 1.

The dielectric material can have absorbent properties, that is to say, a loss tangent coefficient greater than 0.004, to perform an attenuating function.

Each of the upper layer 14, lower layer 16 and central layer 18 extends parallel to a plane XY, defined by the propagation axis X-X illustrated in FIG. 1 and by a transverse axis Y-Y illustrated in FIG. 1 orthogonal to the propagation axis X-X.

Each of the upper layer 14, lower layer 16 and central layer 18 has an upper surface 20A, 20B, 20C and a lower surface 21A, 21B, 21C.

In the first component 10A, each of the upper surfaces 20A, 20B, 20C and each of the lower surfaces 21A, 21B, 21C are electrically conductive.

Hereinafter, "electrically conductive element" means that the element has an electrical conductivity greater than $1*10^6$ $S \cdot m^{-1}$, preferably equivalent to that of a metal of the copper, silver, aluminum or gold type.

The lower layer 16 and the upper layer 14 are placed at a distance from one another, on either side of the central layer 18, in contact with the central layer 18.

In particular, the lower surface 21A of the upper layer 14 is in contact with the upper surface 20C of the central layer 18. Likewise, the lower surface 21C of the central layer 18 is in contact with the upper surface 20B of the lower layer 16.

Thus, the upper layer 14, the lower layer 16 and the central layer 18 form a stack.

The lower surface 21A of the upper layer 14 is electrically coupled to the upper surface 20C of the central layer 18. Likewise, the lower surface 21C of the central layer 18 is electrically coupled to the upper surface 20B of the lower layer 16.

In the remainder of the disclosure, the "transverse direction" Y-Y refers to a direction parallel to the transverse axis Y-Y illustrated in FIG. 1.

A transverse direction is therefore a direction orthogonal to the propagation axis X-X illustrated in FIG. 1 and parallel to the lower surface 21A of the upper layer 14.

In one preferred embodiment, each of the upper layer 14, lower layer 16 and central layer 18 forms a substrate.

Each of the upper layer 14, lower layer 16 and central layer 18 thus comprises an electrically conductive upper sublayer 22A, 22B, 22C, an electrically conductive lower sublayer 24A, 24B, 24C and a dielectric central sublayer 26A, 26B, 26C, having a first dielectric constant, intermediate between the upper sublayer 22A, 22B, 22C and the lower sublayer 24A, 24B, 24C.

Furthermore, the lower sublayer 24A of the upper layer 14 is electrically connected to the upper sublayer 22C of the central layer 18. Likewise, the lower sublayer 24C of the central layer 18 is electrically connected to the upper sublayer 22B of the lower layer 16.

The upper sublayers 22A, 22B, 22C and the lower sublayers 24A, 24B, 24C are for example made from copper.

The central sublayers 26A, 26B, 26C are for example made from epoxide resin or Teflon.

The propagation zone 19 corresponds to a zone in which the electromagnetic wave is combined during its propagation in the waveguide 12.

In the first component 10A of FIGS. 1 and 2, the propagation zone 19 is defined by the electrically conductive lower sublayer 24A of the upper layer 14, the electrically conductive upper sublayer 22B of the lower layer 16 and two central lateral borders 30 each arranged in the central layer 18 and spaced apart from one another.

Furthermore, the propagation zone 19 comprises a cavity 32 delimited by the upper layer 14, the lower layer 16 and, laterally, by the central layer 18.

The central lateral borders 30 of the propagation zone 19 are able to prevent the passage of an electromagnetic wave having a wavelength greater than or equal to the minimum predetermined wavelength.

Each central lateral border 30 electrically connects the lower sublayer 24A of the upper layer 14 and the upper sublayer 22B of the upper layer 14 to one another.

The central lateral borders 30 extend parallel to the propagation axis X-X and here are parallel to one another.

The central lateral borders 30 in particular extend along the direction Z-Z orthogonal to the propagation axis X-X and the transverse axis Y-Y.

Hereinafter, the terms "above" and "below" will be understood with respect to the direction Z-Z as illustrated in FIG. 1.

The central lateral borders 30 in particular extend over the entire thickness of the central layer 18.

The central lateral borders 30 are in particular placed laterally on either side of the cavity 32, for example here outside the cavity 32.

In the embodiment of FIGS. 1 and 2, each central lateral border 30 comprises a row of electrically conductive vias 34, arranged at least through the central cavity 18. A "via" refers to a hole, arranged at least through the central layer 18, having walls covered with an electrically conductive coating, for example metallized.

More specifically, each via 34 extends along the direction Z-Z orthogonal to the propagation axis X-X and through the transverse axis Y-Y, while passing through at least the central layer 18.

Each via 34 electrically connects the lower sublayer 24A of the upper layer 14 and the upper sublayer 22B of the upper layer 14 to one another.

The separation between two successive vias 34 of a central lateral border 30 is smaller than the predetermined minimum wavelength, in particular smaller than one tenth of the predetermined minimum wavelength, preferably smaller than one twentieth of the predetermined minimum wavelength.

In the example illustrated in FIGS. 1 and 2, the cavity 32 is delimited by the lower surface 21A of the upper layer 14, the upper surface 20B of the lower layer 16 and lateral edges 36 of the central layer 18.

The cavity 32 is filled with a fluid 38 having a second dielectric constant for example lower than the first dielectric constant.

The fluid 38 is for example air. In a variant, in the case where the cavity 32 defines a sealed closed volume, the cavity 32 is filled with air, nitrogen or is empty of fluid.

As illustrated in FIG. 1, the lateral edges 36 of the central layer 18 extend parallel to the propagation axis X-X.

The lateral edges 36 of the central layer 18 in particular extend orthogonally to the transverse axis Y-Y.

The lateral borders 36 of the central layer 18 run alongside the central lateral borders 30. "Run alongside" means that the lateral edges 36 are in contact with the central lateral borders 30 or placed at a distance, for example constant, from the central lateral borders 30, this distance preferably being less than 100 μm.

In the first component 10A illustrated in FIGS. 1 and 2, the dielectric strip 28 is placed in the cavity 32, separated from the lateral edges 36 of the cavity 32.

In particular, the dielectric strip 28 is placed in the propagation zone 19 such that, projected on the upper surface 20B of the lower layer 16, the dielectric strip 28 is separated from the lateral edges 36 of the cavity 32.

The dielectric strip 28 is placed between the lateral edges 36 of the cavity 32.

The dielectric strip 28 here has an elongated shape and extends in a longitudinal direction parallel to the propagation axis. Furthermore, the dielectric strip 28 here extends orthogonally to the transverse axis Y-Y.

In the example illustrated in FIG. 1, the dielectric strip 28 has a width in particular between 1% and 90% of the width of the cavity 32.

"Width of an element" refers to the edge-to-edge distance of the element, taken along the transverse axis Y-Y.

The width of the dielectric strip 28 is for example constant along the propagation axis X-X, as illustrated in FIG. 1.

The dielectric strip 28 here is centered on a median plane of the two lateral edges 36.

In this example, the dielectric strip 28 has a thickness smaller than the height of the cavity 32. "Thickness of an element" or "height of an element" refers to the edge-to-edge distance of the element, taken along the direction Z-Z orthogonal to the propagation axis X-X and the transverse axis Y-Y.

Here, the dielectric strip 28 is placed separated from the lower surface 21A of the upper layer 14 and the upper surface 20B of the lower layer 16.

The dielectric strip 28 is fastened to the upper surface 20B of the lower layer 16 by means of a lower contact sublayer 40. More specifically, the dielectric strip 28 is fastened to the lower contact sublayer 40, the lower contact sublayer 40 being fastened to the upper surface 20B of the lower layer 16. The lower contact sublayer 40 is electrically conductive.

The dielectric strip 28 is further fastened to the lower surface 21A of the upper layer 14 by means of an upper contact sublayer 42. More specifically, the dielectric strip 28 is fastened to the upper contact sublayer 42, the upper contact sublayer 42 being fastened to the lower surface 21A of the upper layer 14. The upper contact sublayer 42 is electrically conductive.

A first manufacturing process relative to the manufacturing of the first component 10A according to the invention will now be described, in reference to FIGS. 3 and 4.

The first process comprises providing the upper layer 14 and the lower layer 16.

The first process also comprises providing the central layer 18, the central layer 18 being provided here by providing a plurality of recesses 44, the plurality of recesses 44 being intended to form the cavity 32 of the first component 10A.

The upper layer 14, the lower layer 16 and the central layer 18 are provided separated from one another.

In the first process, the step for providing the central layer 18 comprises providing an initial layer 46, the initial layer 46 being intended to form the central layer 18.

The initial layer 46 thus comprises at least one initial dielectric sublayer 48, having the first dielectric constant, which is in particular intended to form the central sublayer 26C of the central layer 18.

In particular, the initial layer 46 also comprises an electrically conductive initial upper sublayer 50 intended to form the upper sublayer 22C of the central layer 18, and an electrically conductive initial lower sublayer 52 intended to form the lower sublayer 24C of the central layer 18.

The initial layer 46 is provided while being devoid of recess.

The step for providing the central layer 18 then comprises cutting, in the initial layer 46, the plurality of recesses 44 intended to form the cavity 32.

The cutting is carried out in the entire thickness of the initial layer 46.

Before or after the cutting step, the first process comprises a step for implementing central lateral borders 30.

For example, the implementation of the central lateral borders 30 comprises producing the row of vias 34.

In the first process, the step for providing the central layer 18 further comprises producing the dielectric strip 28.

Figure 3:
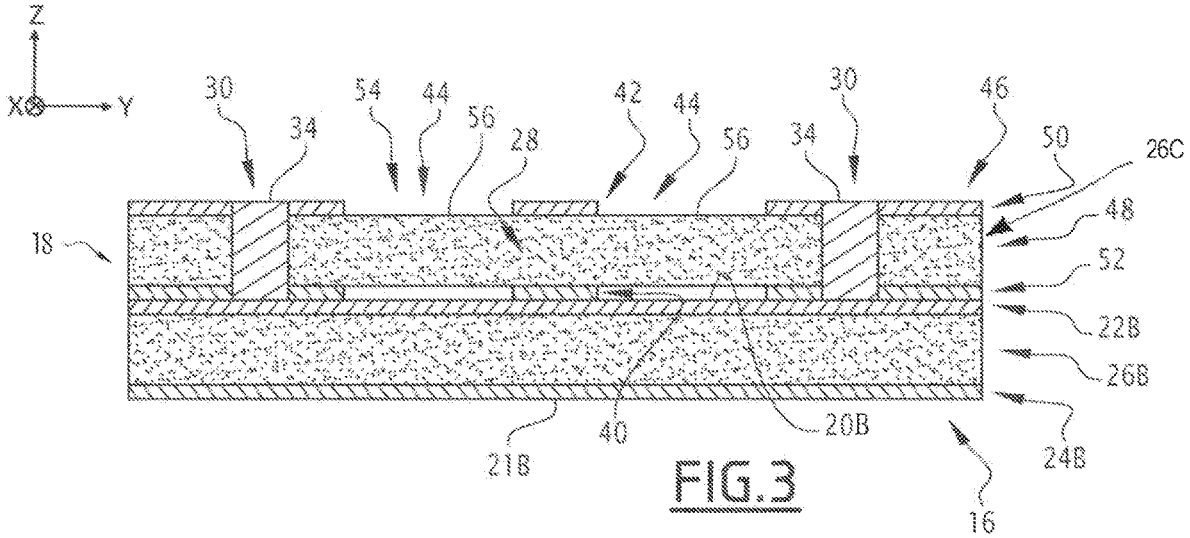
FIG. 3 is a schematic cross-sectional view of the first component during the first manufacturing process.

The production of the dielectric strip 28 here is carried out during the cutting of the plurality of recesses 44, as illustrated in FIG. 3. The plurality of recesses 44 is then intended to define the cavity 32, the dielectric strip 28 and attachment means 54 of the dielectric strip 28.

During the cutting, the dielectric strip 28 is more specifically formed by part of the initial dielectric sublayer 48 of the initial layer 46.

The dielectric strip 28 is thus placed in the initial layer 46. In line with the dielectric strip 28, the electrically conductive initial upper and lower sublayers 50, 52 of the initial layer 46 respectively above and below the dielectric strip 28 respectively form the upper contact sublayer 42 and the lower contact sublayer 40 of the first component 10A.

Figure 4:
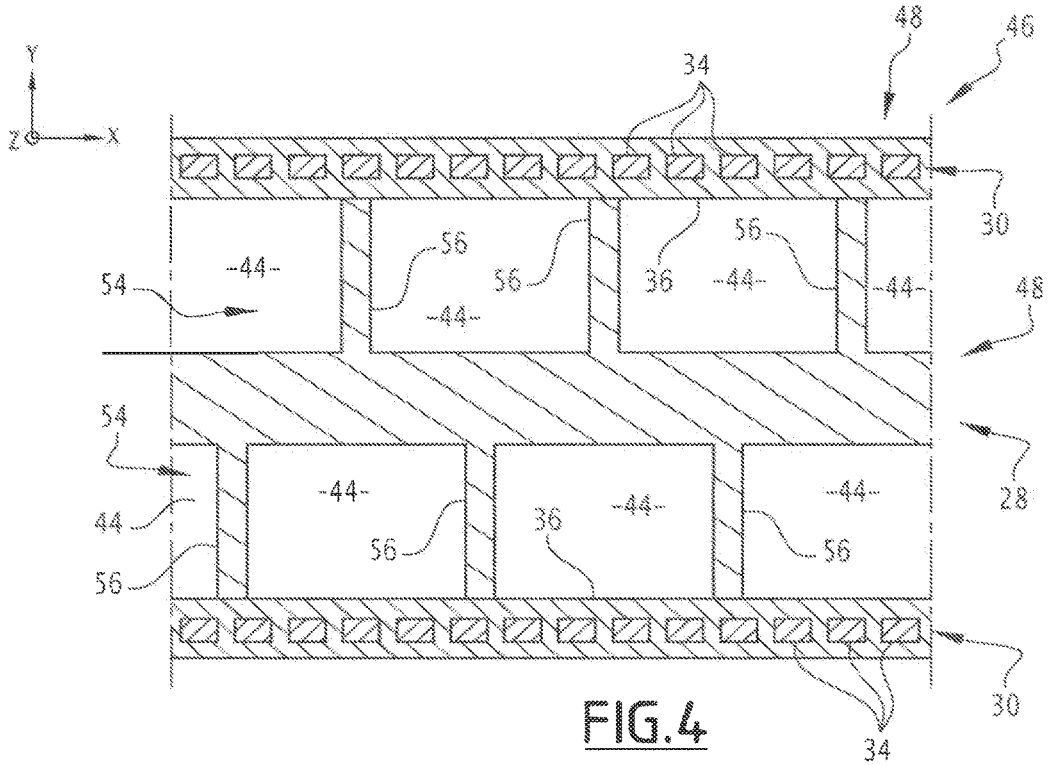
FIG. 4 is a top schematic sectional view of the first component during a first embodiment of a manufacturing process according to the invention, the section passing through the dielectric strip.

As illustrated in FIG. 4, the attachment means 54 comprise a plurality of dielectric fasteners 56 coupling the dielectric strip 28 to at least one of the lateral edges 36 of the cavity 32.

Thus, the dielectric strip 28, the dielectric fasteners 56 and the lateral edges 36 of the cavity 32 are integral.

As illustrated in FIG. 4, each dielectric fastener 56 is in the form of a rectilinear bar, and here extends perpendicularly from one of the lateral edges 36.

In the example illustrated in FIG. 4, at least one dielectric fastener 56 extends from each of the lateral edges 36.

The dielectric fasteners 56 are separated from one another.

In the first process, as illustrated in FIG. 4, the distance between two adjacent dielectric fasteners 56 is equal for all of the dielectric fasteners 56.

Projected on the propagation axis X-X, each dielectric fastener 56 extending from one of the lateral edges 36 is positioned substantially in the middle of two adjacent dielectric fasteners 56 extending from the opposite lateral edge 36.

The production of the dielectric strip 28 for example comprises eliminating the electrically conductive initial upper and lower sublayers 50, 52 in line with the dielectric fasteners 56, in particular above and below the dielectric fasteners 56.

In this example, the dielectric fasteners 56 have a thickness smaller than the height of the cavity 32.

At the end of the step for producing the dielectric strip 28 and the cutting step, the initial layer 46 forms the central layer 18.

At the end of the production step, the dielectric strip 28 is placed between a plane defined by the upper surface 20C of the central layer 18 and a plane defined by a lower surface 21C of the central layer 18.

The dielectric strip 28 is thus intended to be placed in the cavity 32, between the lateral edges 36.

Hereinafter, the first process comprises the assembly of the upper layer 14, the lower layer 16 and the central layer 18, such that the central layer 18 is intermediate between the upper layer 14 and the lower layer 16.

Throughout the entire manufacturing process, the layers 14, 16, 18 are aligned with one another by means of centering studs or by a camera with test charts.

As illustrated in FIG. 3, the assembly first comprises attaching the central layer 18 to the lower layer 16. This attachment is for example done by gluing.

During this attachment step, the dielectric strip 28 is likewise attached to the lower layer 16.

Throughout the entire duration of this attachment, the dielectric strip 28 is kept in position relative to the central layer 18 and the lower layer 16 by the dielectric fasteners 56. The positioning of the dielectric strip 28 is therefore relatively imprecise and chosen during the cutting step.

In the first process, the assembly next comprises the removal of the attachment means 54, once the central layer 18 is fastened to the lower layer 16, in particular once the dielectric strip 28 is fastened to the lower layer 16.

This removal is carried out by the cutting of the attachment means 54, in particular by the cutting of the dielectric fasteners 56. The preceding step for eliminating the electrically conductive initial upper and lower sublayers 50, 52 makes it possible to facilitate this step for cutting of the dielectric fasteners 56.

This cutting is for example done manually with a scalpel, a digital milling machine or a laser.

Each dielectric fastener 56 is preferably cut while being flush with the lateral edge 36 from which the dielectric fastener 56 extends.

Furthermore, each dielectric fastener 56 is advantageously cut while being flush with the dielectric strip 28.

Subsequently, the assembly comprises the attachment of the upper layer 14 to the central layer 18, as illustrated in FIG. 2. This attachment is for example done by gluing.

During this attachment, the cavity 32 is then formed by the plurality of recesses 44 while being delimited by the upper layer 14, the lower layer 16, and laterally, by the opposite lateral edges 36 of the central layer 18.

After assembly, the first component 10A is formed, as illustrated in FIG. 2. In particular, the layers 14, 16, 18 define the propagation zone 19 of an electromagnetic wave.

The propagation zone 19 is then defined by the electrically conductive lower sublayer 24A of the upper layer 14, the electrically conductive upper sublayer 22B of the lower layer 16 and the central lateral borders 30.

This propagation zone 19 comprises the cavity 32.

After the assembly step, the dielectric strip 28 is placed in the cavity 32, separated from the lateral edges 36 of the cavity 32.

In particular, after the assembly step, the dielectric strip 28, placed in the central layer 18, is placed in the propagation zone 19 and, projected on the upper surface 20B of the lower layer 16, separated from the lateral edges 36 of the cavity 32.

During use, the first process comprises a step for supplying the first microwave component 10A with an electromagnetic wave propagating in the propagation zone 19. The electromagnetic wave has at least one propagation mode having an electric field maximum.

The dielectric strip 28 is positioned in the cavity 32 in a predetermined position such that, during this supply step of the first component 10A, the predetermined position corresponds to the level of the electric field maximum.

More specifically, during the step for producing the dielectric strip 28, the dimensions of the dielectric fasteners 56 are predetermined such that, after assembly, the dielectric strip 28 is located in the cavity 32 in the predetermined position.

The dielectric strip 28 thus has an effect on the propagation mode. In particular, the dielectric strip 28 charges the waveguide 12 so as to broaden the monomodal bandwidth.

Additionally, after use, the structure comprising three layers 14, 16, 18 makes it possible to make the first component 10A compact and flexible.

In a variant, not shown, of the first component 10A, the waveguide 12 comprises a first electrically insulating layer between the lower sublayer 24A of the upper layer 14 and the upper sublayer 22C of the central layer 18, and/or a second electrically insulating layer between the lower sublayer 24C of the central layer 18 and the upper sublayer 22B of the lower layer 16.

The insulating layer(s) are for example made from prepreg.

Each central lateral border 30, and in particular each via 34, passes through the insulating layer(s).

In a variant, not shown, of the first component 10A, the dielectric strip 28 is not centered on a median plane of the two lateral edges 36, but is laterally offset from the median plane. Such a lateral offset makes it possible to provide control of the desired propagation modes of the electromagnetic waves propagating in the waveguide 12.

In a variant, not shown, of the first component 10A, the width of the dielectric strip 28 varies along the propagation axis.

In a variant, not shown, of the first component 10A, the waveguide 12 comprises electrically conductive wires passing all the way through the cavity 32, and electrically connecting the lower sublayer 24A of the upper layer 14 to the upper layer 22B of the lower layer 16. These wires make it possible to perform an impedance adaptation to another circuit.

In a variant, not shown, of the first component 10A, the waveguide 12 comprises electrically conductive wires passing through the cavity 32, electrically connected to the lower sublayer 24A of the upper layer 14, and having a free end separated from the upper layer 22B of the lower layer 16. These wires make it possible to produce capacitive studs making it possible to adjust filtering properties of the component.

Figure 5:
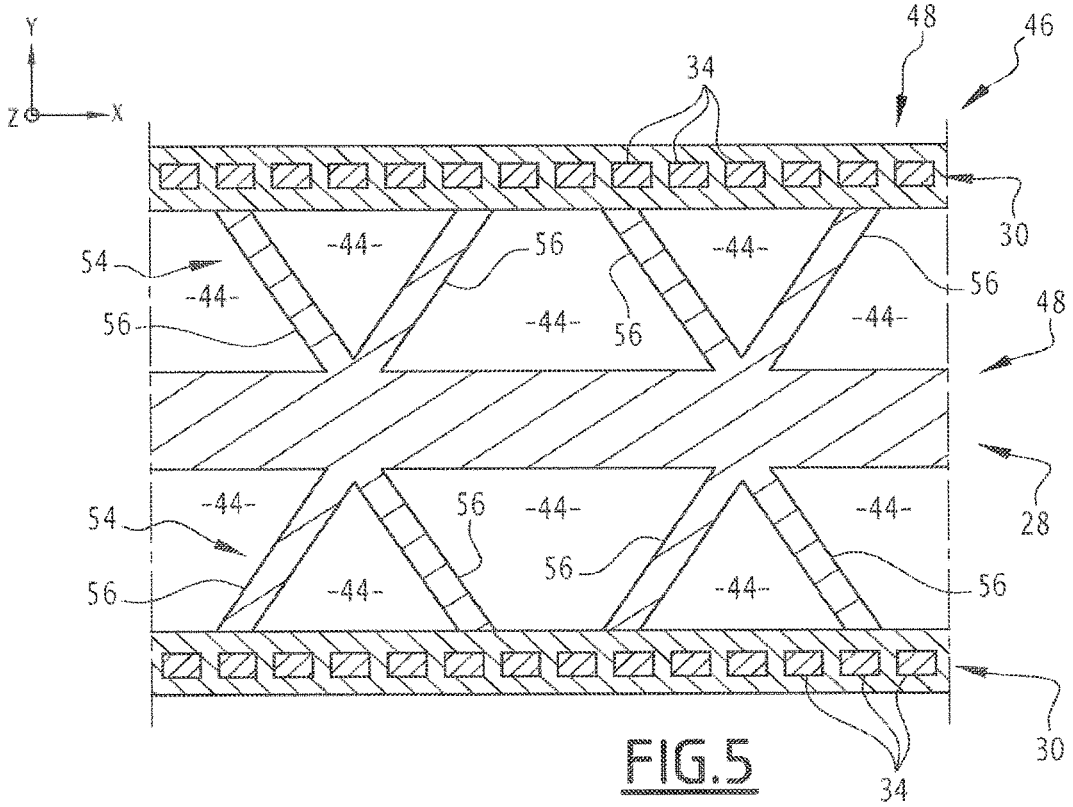
FIG. 5 is a top schematic sectional view of the first component during a variant of the manufacturing process of the first component according to the invention, the section passing through the dielectric strip.

FIG. 5 shows a variant of the manufacturing process of the first component 10A.

This variant differs from the first described process in that the median plane of the two lateral edges 36 is a plane of symmetry of the dielectric fasteners 56.

Furthermore, each dielectric fastener 56 does not extend perpendicularly from one of the lateral edges 36.

At least two dielectric fasteners 56 extend from a same lateral edge 36, coming together at the dielectric strip 28. As illustrated in FIG. 5, these two dielectric fasteners 56 form a pattern that repeats along the propagation axis.

More generally, for each dielectric fastener 56, another dielectric fastener 56 extends from the same lateral edge 36, coming together at the dielectric strip 28.

In a variant, not shown, of the first manufacturing process, the production of the dielectric strip 28 does not comprise eliminating the electrically conductive initial upper and lower sublayers 50, 52 in line with the dielectric fasteners 56. These sublayers 50, 52 are eliminated during the removal of the attachment means 54.

In a variant, not shown, of the first manufacturing process, the dielectric fasteners 56 extend from only one of the lateral edges 36.

Figure 6:
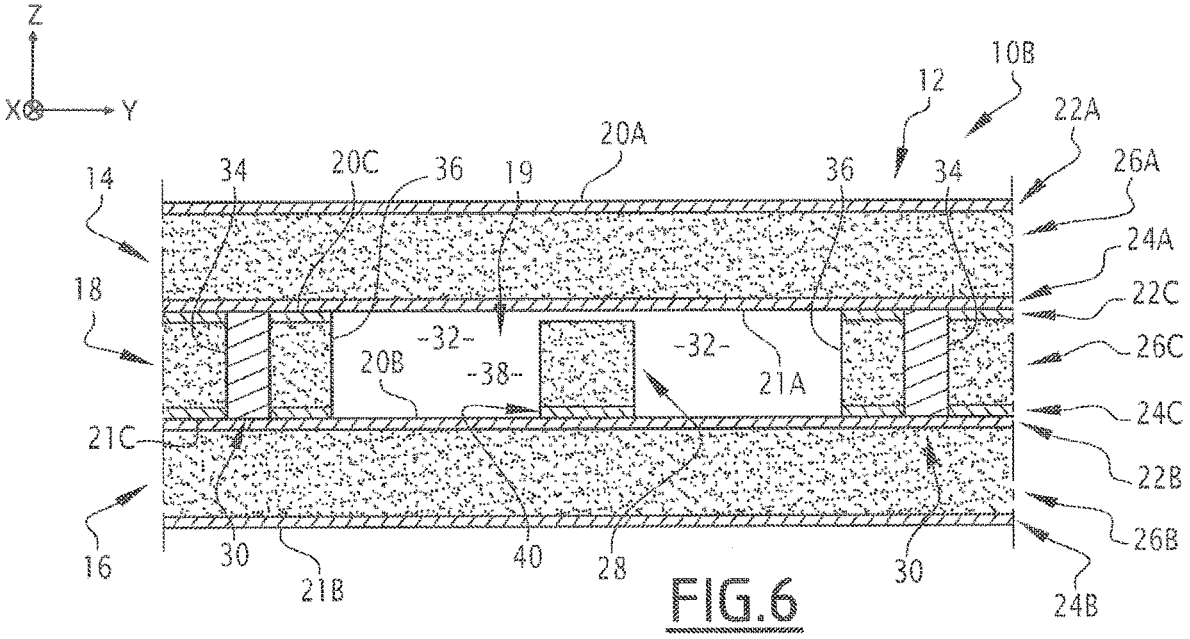
FIG. 6 is a schematic cross-sectional view of a second microwave component according to the invention.

A second microwave component 10B will now be described in reference to FIG. 6.

This second component 10B differs from the first component 10A in that the dielectric strip 28 and the lower surface 21A of the upper layer 14 define a free space between them.

The dielectric strip 28 is thus not fastened to the lower surface 21A of the upper layer 14 by means of the upper contact sublayer 42.

The waveguide 12 is then devoid of the upper contact sublayer 42.

A second manufacturing process relative to the manufacturing of the second component 10B differs from the first process in that the production of the dielectric strip 28 comprises eliminating the electrically conductive initial upper sublayer 50 above the dielectric strip 28.

A third microwave component 10C will now be described in reference to FIG. 7.

This third component 10C differs from the first component 10A in that the waveguide 12 further comprises a functional attachment component 58.

The functional attachment component 58 is formed by a plurality of dielectric fasteners 56 that are integral with the dielectric strip 28, each dielectric fastener 56 extending from one of the lateral edges 36.

The dielectric fasteners 56 have characteristics identical to the dielectric fasteners described in the first process.

Figure 7:
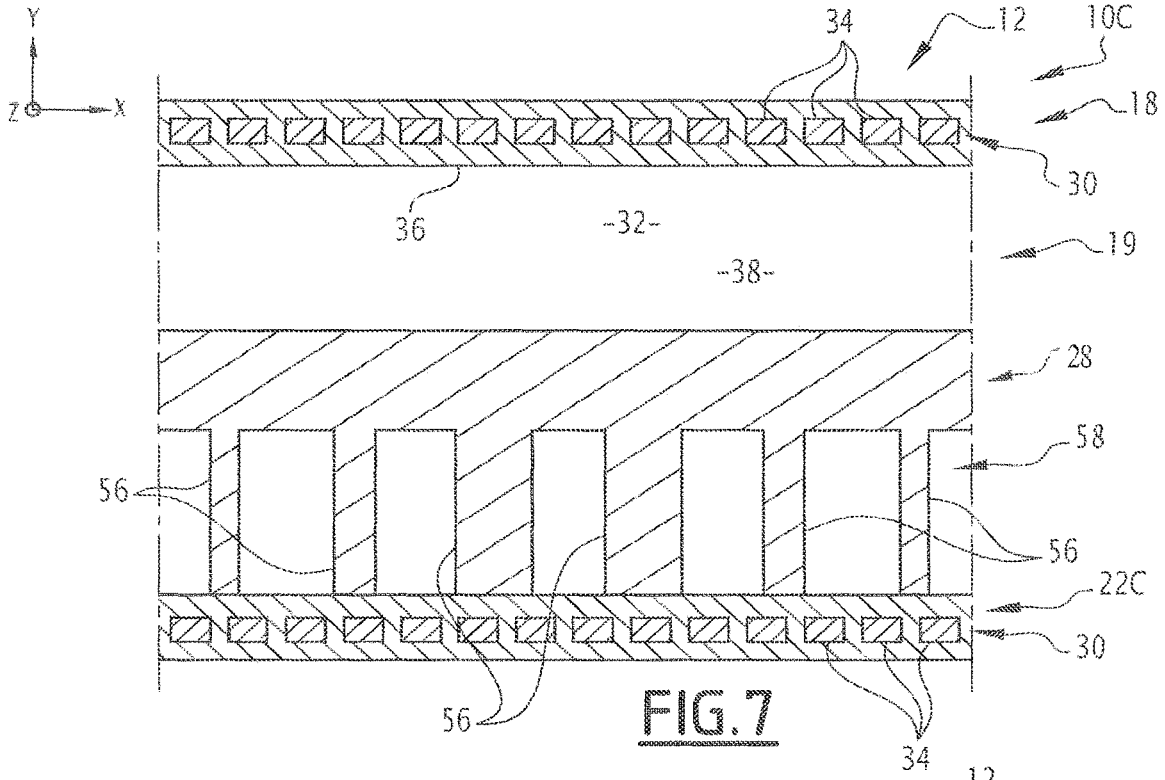
FIG. 7 is a top schematic sectional view of a third microwave component according to the invention, the section passing through the dielectric strip.

In the third component 10C illustrated in FIG. 7, the dielectric fasteners 56 extend from only one of the lateral edges 36.

The dielectric strip 28 is therefore separated from the lateral edges 36 in at least one region of the dielectric strip 28.

Furthermore, the dielectric fasteners 56 are configured to perform a filter function for an electromagnetic wave propagating in the propagation zone 19.

In particular, the separation between two adjacent dielectric fasteners 56, and their dimensions, are predetermined to perform the filter function.

A third manufacturing process relative to the manufacturing of the third component 10C differs from the first process in that at least part of the attachment means 54 is not removed during the assembly step.

The upper layer 14 is fastened to the central layer 18 without removing all of the dielectric fasteners 56.

The part of the attachment means 54 then forms the functional attachment component 58, the dielectric fasteners 56 not removed being configured to perform the filter function for an electromagnetic wave propagating in the propagation zone 19.

In particular, during the step for producing the dielectric strip 28, the separation between two adjacent dielectric fasteners 56, and their dimensions, are predetermined to perform the filter function.

In a variant, not shown, of the third component 10C, the width of the dielectric strip 28 varies along the propagation axis.

In a variant, not shown, of the third component 10C, the width of the dielectric strip 28 is constant between two adjacent dielectric fasteners 56, and the width of the dielectric strip 28 between a pair of adjacent dielectric fasteners 56 is different for at least two pairs of adjacent dielectric fasteners 56.

In another variant, not shown, of the third component 10C, the width of the dielectric strip 28 taken at a dielectric fastener 56 is different from the width of the dielectric strip 28 taken at an adjacent dielectric fastener 56. The side of the dielectric strip 28 joining the two adjacent dielectric fasteners 56 then has, in top view, a predetermined profile chosen from among: a straight line or a curve.

Figure 8:
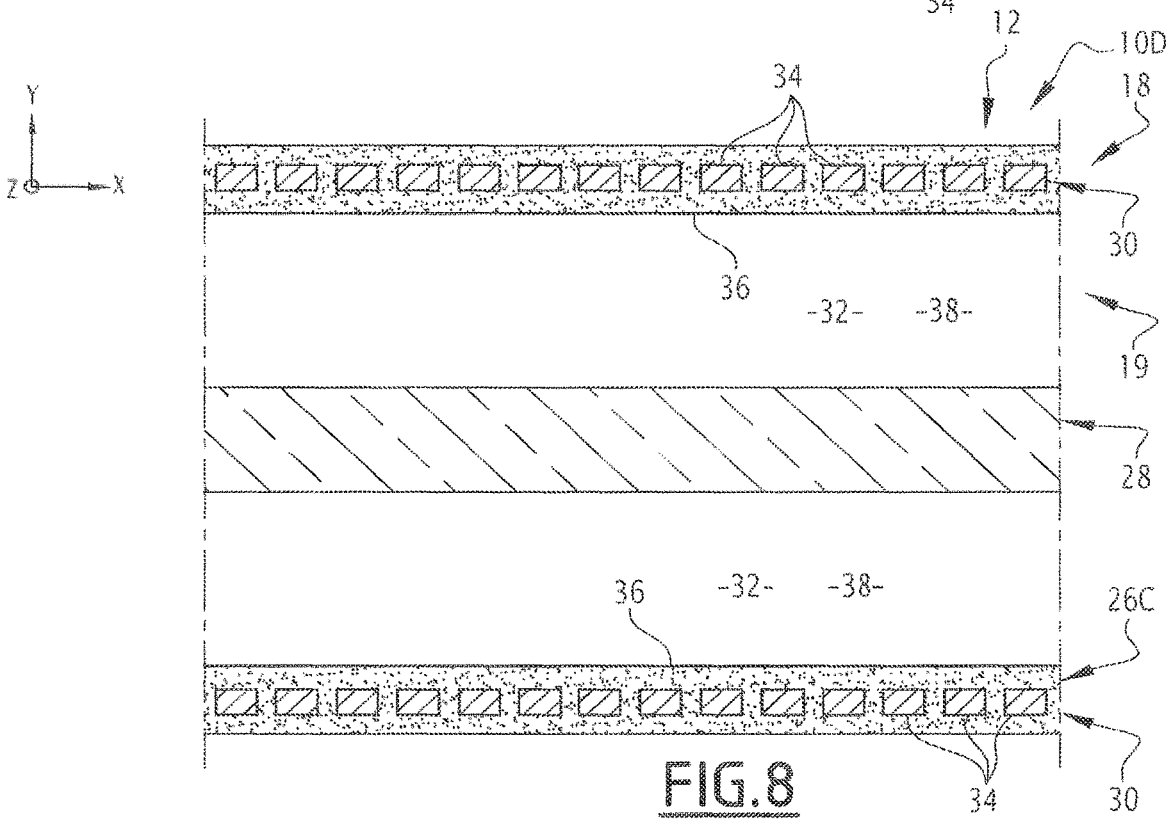
FIG. 8 is a top schematic sectional view of a fourth component according to the invention, the section passing through the dielectric strip.

A fourth component 10D according to the invention is illustrated in FIG. 8.

This fourth component 10D differs from the first component 10A in that the dielectric strip 28 is made from a dielectric material different from the material from which the central sublayer 26C of the central layer 18 is made.

The dielectric strip 28 is in contact with the upper surface 20B of the lower layer 16.

In particular, the dielectric strip 28 is fastened to the upper surface 20B of the lower layer 16, for example by gluing.

In this example, the dielectric strip 28 is in contact with the lower surface 21A of the upper layer 14. In other words, the dielectric strip 28 has a thickness equal to the height of the cavity 32.

In particular, the dielectric strip 28 is fastened to the lower surface 21A of the upper layer 14, for example by gluing.

In a variant, not shown, of the fourth component 10D, the dielectric strip 28 and the lower surface 21A of the upper layer 14 define a free space there between. In other words, the dielectric strip 28 is devoid of contact with the lower surface 21A of the upper layer 14. The thickness of the dielectric strip 28 is therefore smaller than the thickness of the central layer 18.

In a variant, not shown, of the fourth component 10D, the waveguide 12 includes a functional attachment component 58 similar to the functional attachment component 58 of the third component 10C.

A fourth manufacturing process relative to the manufacturing of the fourth component 10D will now be described.

The fourth process differs from the first process in that the dielectric strip 28 and the attachment means 54 are not cut in the central layer 18, and in that the step for producing the dielectric strip 28 comprises providing the dielectric strip 28 and attachment means 54 of the dielectric strip 28, the dielectric strip 28 and the attachment means 54 being provided separated from the central layer 18.

The central layer 18 is provided while having a recess 44 intended by itself to form the cavity 32.

The attachment means 54 have characteristics identical to the attachment means of the first process, but differ from the latter in that the dielectric fasteners 56 are not integral with the lateral edges 36 of the cavity 32.

The attachment means 54 thus comprise the plurality of dielectric fasteners 56 secured to the dielectric strip 28, the dielectric fasteners 56 being secured to the dielectric strip 28, for example integral with the dielectric strip 28.

The dielectric strip 28 and the dielectric fasteners 56 are preferably made from a dielectric material different from the material from which the central sublayer 26C of the central layer 18 is made. In a variant, the dielectric strip 28 and the dielectric fasteners 56 are made from the same material as that of the central sublayer 26C of the central layer 18.

During the assembly, the dielectric strip 28 is fastened to the lower layer 16.

The dielectric strip 28 is kept in position relative to the lower layer 16, by the dielectric fasteners 56 throughout the entire duration necessary for its attachment to the lower layer 16.

Hereinafter, the central layer 18 is fastened to the lower layer 16, the dielectric strip 28 then being placed in the recess 44.

Figure 9:
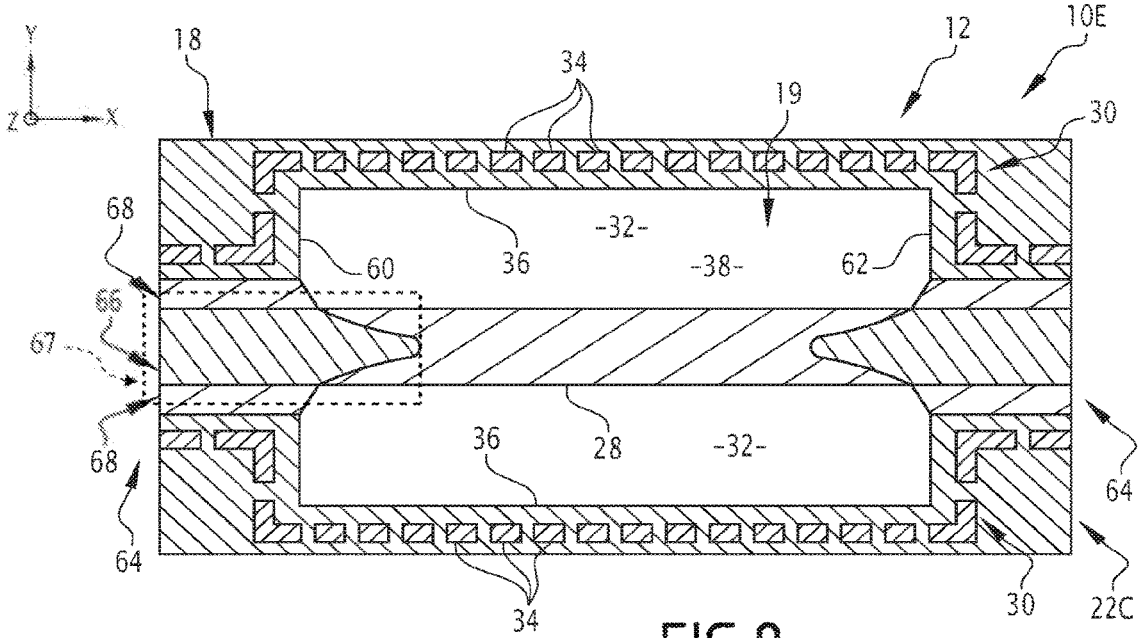
FIG. 9 is a top schematic sectional view of a fifth microwave component according to the invention, the section passing through the dielectric strip, with representation of lower attached layers in phantom.
Figure 10:
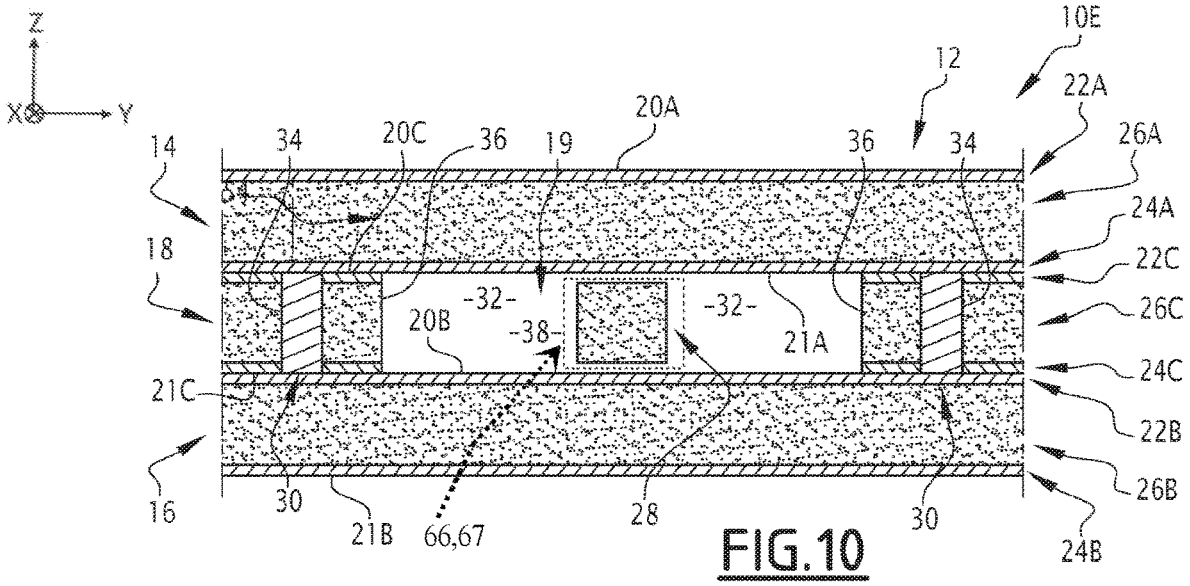
FIG. 10 is a schematic cross-sectional view of the fifth component of FIG. 9, with representation of lower attached layers and upper attached layers in phantom.

A fifth component 10E according to the invention is illustrated in FIGS. 9 and 10.

This fifth component 10E differs from the first component 10A in that the cavity 32 is defined along the propagation axis between a front end 60 and a rear end 62 of the central layer 18, the dielectric strip 28 extending from the front end 60 to the rear end 62.

The cavity 32 has, projected on the upper surface 20B of the lower layer 16, a closed outer contour.

As illustrated in FIG. 9, the fifth component 10E further comprises two attached transmission lines 64, placed longitudinally on either side of the cavity 32, the propagation zone 19, and the central lateral borders 30, extending in each of these two attached transmission lines 64.

Each attached transmission line 64 comprises an electrically conductive upper attached layer 66, identical to the upper layer 14 and integral with the upper layer 14, an electrically conductive lower attached layer 67, identical to the lower layer 16 and integral with the lower layer 16, and a dielectric central attached layer 68, identical to the central layer 18 and integral with the central layer 18.

The attached transmission lines 64 are devoid of cavity 32.

The separation, taken along the transverse axis Y-Y, between the central lateral borders 30, is larger in the cavity 32 at their separation in the attached transmission lines 64.

The dielectric strip 28 is secured with the central sublayer 26C of the central layer 18. In particular, the dielectric strip 28 here is secured with the central sublayer 26C of the central layer 18.

The dielectric strip 28 is thus in particular secured with the attached central layer 68 of each of the attached transmission lines 64.

The dielectric strip 28 has a length equal to the length of the cavity 32. "Length of an element" refers to the edge-to-edge distance of the element, taken along the propagation axis.

Furthermore, the embodiment of the fifth component 10E illustrated in FIG. 10 differs from the first component 10A in that, in at least one segment of the cavity 32, taken along the transverse axis Y-Y, the dielectric strip 28 respectively defines, with the lower surface 21A of the upper layer 14 and the upper surface 20B of the lower layer 16, a free space.

More specifically, the upper attached layers 66 and the lower attached layers 67 protrude in the cavity 32 respectively above and below the dielectric strip 28.

Projected on the upper surface 20B of the lower layer 16, the projections in the cavity 32 of the upper attached layers 66 and the lower attached layers 67 have a pointed shape.

A fifth manufacturing process relative to the manufacturing of the fifth component 10E will now be described.

The fifth process differs from the first process in that during the cutting of the plurality of recesses 44, the plurality of recesses 44 is intended to define the cavity 32, along the propagation axis, between a front end 60 and a rear end 62 of the central layer 18.

During the cutting, the plurality of recesses 44 is intended to define the cavity 32 such that the cavity 32 has, projected on the upper surface 20B of the lower layer 16, a closed outer contour.

The cut plurality of recesses 44 defines the dielectric strip 28, the dielectric strip 28 extending from the front end 60 to the rear end 62, and in particular having a length equal to the length of the cavity 32.

For example, the plurality of recesses 44 defines the dielectric strip 28 without defining dielectric fasteners 56 coupling the dielectric strip 28 to the rest of the central layer 18.

Furthermore, the implementation of central lateral borders 30 is done such that, after assembly, the propagation zone 19 extends longitudinally on either side of the cavity 32. The upper layer 14, the lower layer 16 and the central layer 18 then define the two attached transmission lines 64 on either side of the cavity 32.

During use, during the step for supplying the fifth microwave component 10E with an electromagnetic wave, the wave propagates in the propagation zone 19 in one of the attached transmission lines 64.

The projections of the upper attached layers 66 and lower attached layers 67 make it possible to ensure a good electromagnetic transition for the waves propagating in the propagation zone 19 between the attached transmission lines 64 and the cavity 32.

Figure 11:
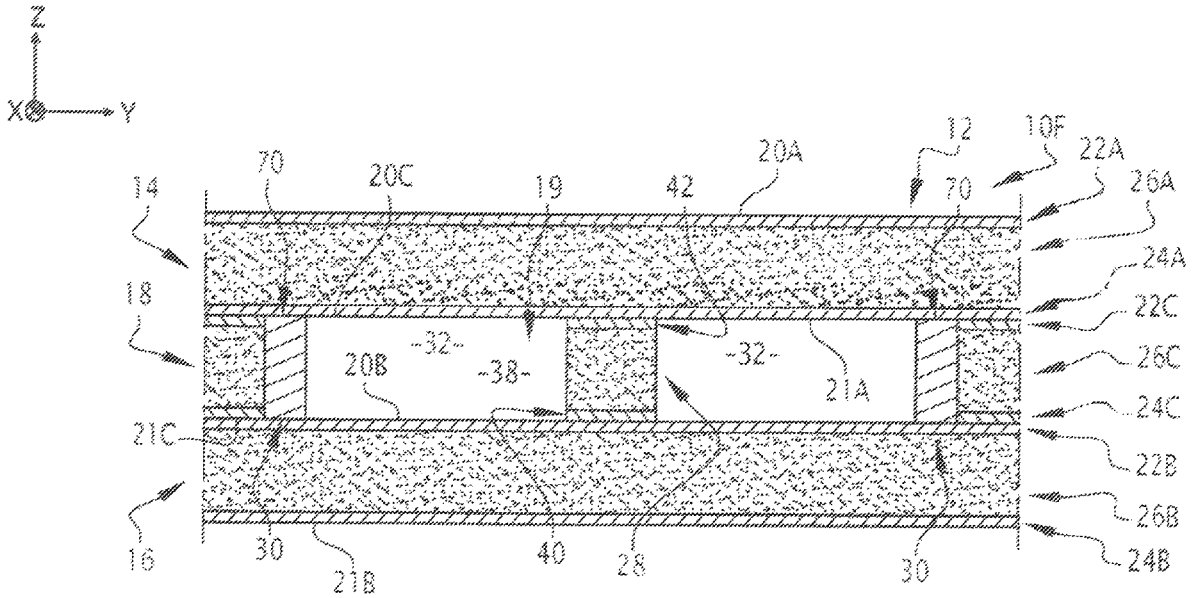
FIGS. 11 to 17 are respective schematic sectional views of sixth, seventh, eighth, ninth, tenth, eleventh and twelfth components according to the invention.

A sixth microwave component 10F will now be described in reference to FIG. 11.

This sixth component 10F differs from the previous embodiments in that the central lateral borders 30 do not comprise rows of vias 34.

Each central lateral border 30 comprises an electrically conductive continuous lateral wall 70.

The continuous lateral wall 70 is in particular formed by an electrically conductive coating, for example metallic. The coating here is applied on the lateral edges 36 of the cavity 32.

"Continuous lateral wall" means that the metallic coating is applied on the entire height and length of the lateral edges 36.

The central lateral borders 30 are in particular devoid of vias.

A sixth manufacturing process relative to the manufacturing of the sixth component 10F will now be described.

The sixth process differs from the first process in that the step for implementing central lateral borders 30 is carried out after the step for cutting the plurality of recesses 44.

This step for implementing central lateral borders 30 comprises producing an electrically conductive continuous lateral wall 70, by applying an electrically conductive coating, for example metallic, on edges of the plurality of recesses 44, these edges being intended to form the lateral edges 36 of the cavity 32.

A seventh component 10G according to the invention will now be described in light of FIG. 12.

This seventh component 10G differs from the first component 10A in that the dielectric strip 28 is a first dielectric strip 28, and in that the waveguide 12 further comprises a second dielectric strip 72.

The second dielectric strip 72 is placed in the cavity 32, separated from the first dielectric strip 28, and separated from the lateral edges 36 of the cavity 32.

In particular, the second dielectric strip 72 is placed in the propagation zone 19 such that, projected on the upper surface 20B of the lower layer 16, the second dielectric strip 72 is separated from the lateral edges 36 of the cavity 32.

The second dielectric strip 72 is placed between the lateral edges 36 of the cavity 32.

The first dielectric strip 28 and the second dielectric strip 72 respectively extend along a longitudinal direction parallel to the propagation axis X-X. Furthermore, the first dielectric strip 28 and the second dielectric strip 72 extend here orthogonally to the transverse axis Y-Y.

The first dielectric strip 28 and the second dielectric strip 72 are laterally offset from the median plane of the two lateral edges 36.

Figure 12:
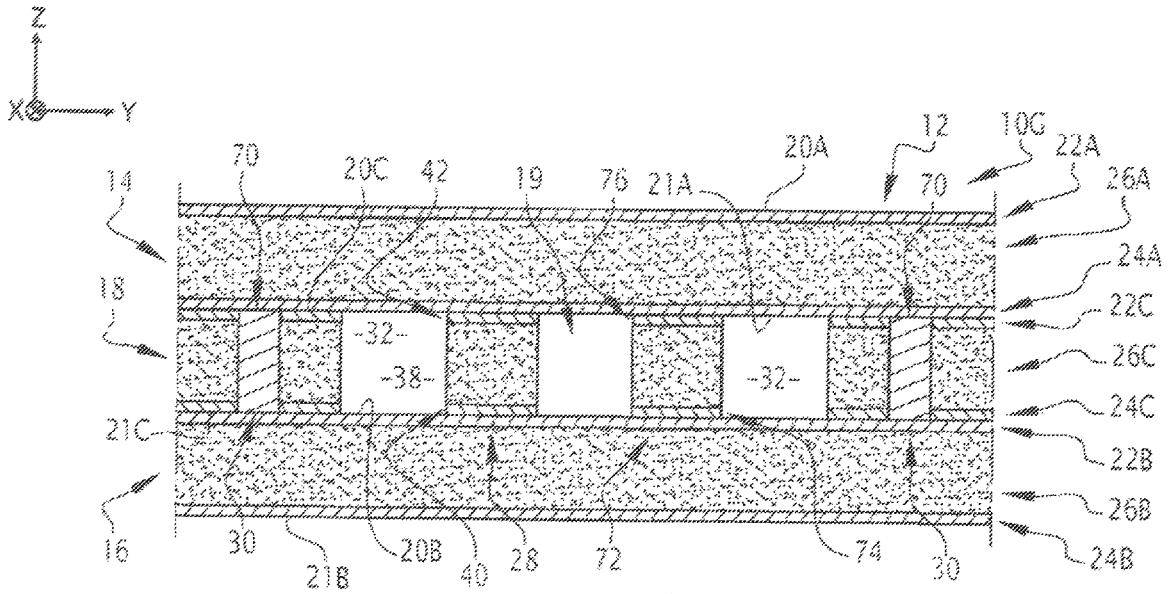

In the example illustrated in FIG. 12, the second dielectric strip 72 is at least partially positioned between the first dielectric strip 28 and one of the lateral edges 36.

The second dielectric strip 72 is substantially similar to the first dielectric strip 28.

The second dielectric strip 72 has a width in particular between 1% and 90% of the width of the cavity 32.

The width of the second dielectric strip 72 is for example constant along the propagation axis X-X. In a variant, the width of the second dielectric strip 72 varies along the propagation axis.

In this example, the second dielectric strip 72 has a thickness smaller than the height of the cavity 32.

Here, the second dielectric strip 72 is placed separated from the lower surface 21A of the upper layer 14 and the upper surface 20B of the lower layer 16.

The second dielectric strip 72 is fastened to the upper surface 20B of the lower layer 16 by means of a second lower contact sublayer 74. More specifically, the second dielectric strip 72 is fastened to the second lower contact sublayer 74, the second lower contact sublayer 74 being fastened to the upper surface 20B of the lower layer 16. The second lower contact sublayer 74 is electrically conductive.

The second dielectric strip 72 is further fastened to the lower surface 21A of the upper layer 14 by means of a second upper contact sublayer 76. More specifically, the second dielectric strip 72 is fastened to the second upper contact sublayer 76, the second upper contact sublayer 76 being fastened to the lower surface 21A of the upper layer 14. The second upper contact sublayer 76 is electrically conductive.

A seventh manufacturing process relative to the manufacturing of the seventh component 10G will now be described.

The seventh process differs from the first process in that the step for providing the central layer 18 comprises a step for producing the first dielectric strip 28 and the second dielectric strip 72.

The production of the first dielectric strip 28 and the second dielectric strip 72 here is carried out during the cutting of the plurality of recesses 44.

During the cutting of the plurality of recesses 44, the plurality of recesses 44 is intended to define the first dielectric strip 28, the second dielectric strip 72 and attachment means 54 of the first dielectric strip 28 and the second dielectric strip 72.

During the cutting, the first dielectric strip 28 and the second dielectric strip 72 are more specifically formed by part of the initial dielectric sublayer 48 of the initial layer 46.

In line with the second dielectric strip 72, the electrically conductive initial upper and lower sublayers 50, 52 of the initial layer 46 respectively above and below the second dielectric strip 72 respectively form the second upper contact sublayer 76 and the second lower contact sublayer 74 of the seventh component 10G.

The attachment means 54 comprise a plurality of first dielectric fasteners coupling the first dielectric strip 28 to one of the lateral edges 36 of the cavity 32. The attachment means 54 further comprise a plurality of second dielectric fasteners coupling the second dielectric strip 72 to the other of the lateral edges 36 of the cavity 32.

For example, the attachment means 54 comprise a plurality of intermediate dielectric fasteners coupling the first dielectric strip 28 to the second dielectric strip 72.

The first dielectric fasteners, the second dielectric fasteners and the intermediate dielectric fasteners have characteristics substantially identical to the dielectric fasteners 56 described in the first process.

Like in the first process, during use, the seventh process comprises a step for supplying the seventh microwave component 10G with an electromagnetic wave propagating in the propagation zone 19.

The electromagnetic wave here has at least first and second propagation modes, the second propagation mode having two electric field maximums.

The first dielectric strip 28 and the second dielectric strip 72 are respectively positioned in the cavity 32 in a first predetermined position and a second predetermined position such that, during this supply step of the seventh component 10G, the first predetermined position and the second predetermined position respectively correspond to the levels of the electric field maximums.

More specifically, during the step for producing the dielectric strip 28, the dimensions of the first fasteners and second fasteners are predetermined such that, after assembly, the first dielectric strip 28 and the second dielectric strip 72 are respectively located in the cavity 32 at the electric field maximums.

The first dielectric strip 28 and the second dielectric strip 72 thus have an effect on the second propagation mode. In particular, the first dielectric strip 28 and the second dielectric strip 72 decrease the monomodal band of the seventh component 10G in order to obtain a controlled bimodal structure.

An eighth component 10H will now be described in reference to FIG. 13.

This eighth component 10H differs from the fourth component 10D in that the dielectric strip 28 is a first dielectric strip 28, and in that the waveguide 12 comprises at least one other dielectric strip 72.

Figure 13:
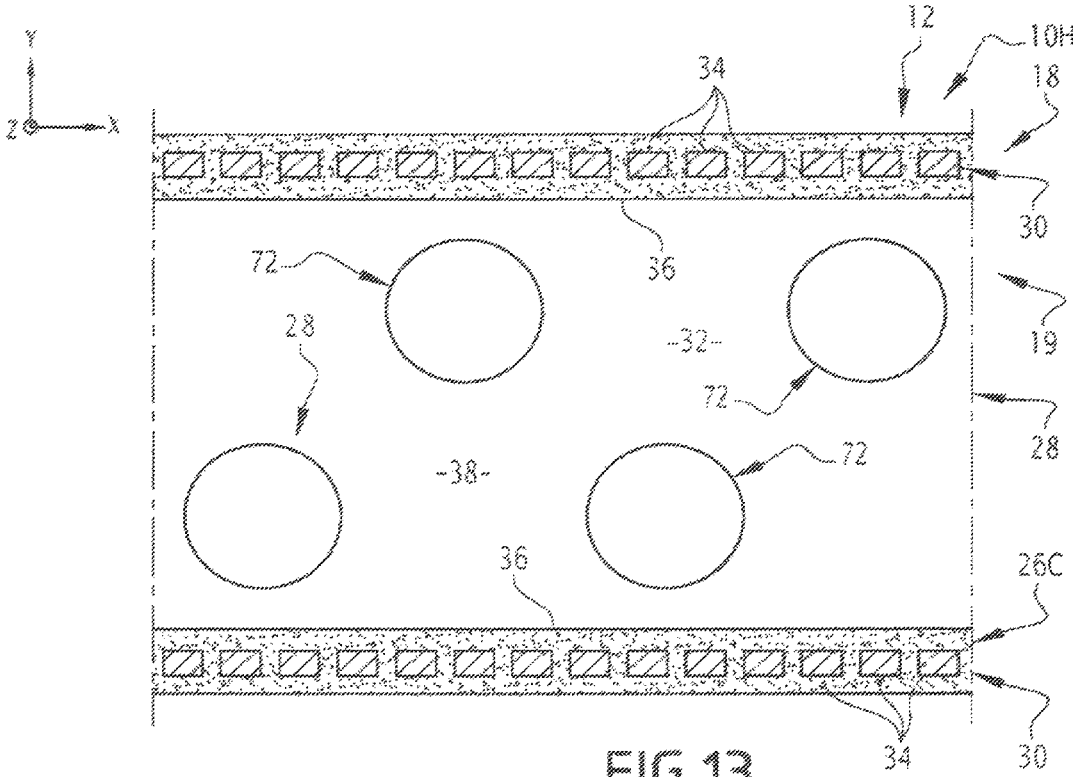

In the example illustrated in FIG. 13, the waveguide 12 comprises at least three other dielectric strips 72.

Each other dielectric strip 72 is placed in the cavity 32, separated from the first dielectric strip 28, separated from each other dielectric strip 72 and separated from the lateral edges 36 of the cavity 32.

In particular, each other dielectric strip 72 is placed in the propagation zone 19 such that, projected on the upper surface 20B of the lower layer 16, the other dielectric strip 72 is separated from the lateral edges 36 of the cavity 32.

Each other dielectric strip 72 is placed between the lateral edges 36 of the cavity 32.

The first dielectric strip 28 and each other dielectric strip 72 respectively extend along a longitudinal direction parallel to the propagation axis X-X. Furthermore, the first dielectric strip 28 and each other dielectric strip 72 extend here orthogonally to the transverse axis Y-Y.

The first dielectric strip 28 and each other dielectric strip 72 are laterally offset from the median plane of the two lateral edges 36.

Projected on the upper surface 20B of the lower layer 16, the first dielectric strip 28 and each other dielectric strip 72 respectively define a circular outer contour. The term "strip" here must therefore be understood broadly.

In the example illustrated in FIG. 13, each other dielectric strip 72 is substantially similar to the first dielectric strip 28. In particular, here each other dielectric strip 72 and the first dielectric strip 28 have a substantially identical diameter.

The first dielectric strip 28 and each other dielectric strip 72 then respectively have a dielectric permittivity greater than 6.

An eighth manufacturing process relative to the manufacturing of the eighth component 10H will now be described.

The eighth process differs from the fourth process in that the eighth process comprises a step for producing each other dielectric strip 72. The step for producing each other dielectric strip 72 comprises providing the other dielectric strip 72 and means for attaching the other dielectric strip 72, the other dielectric strip 72 and the attachment means being provided separated from the central layer 18.

During the assembly, each other dielectric strip 72 is fastened to the lower layer 16, in particular before the central layer 18 is fastened to the lower layer 16.

In a variant of the eighth component 10H, projected on the upper surface 20B of the lower layer 16, at least one of the first dielectric strip 28 and each other dielectric strip 72 defines an outer contour having a rectangular, square or oval shape.

In still another variant of the eighth component 10H, projected on the upper surface 20B of the lower layer 16, at least one of the first dielectric strip 28 and each other dielectric strip 72 defines a ring shape, having an outer contour with a circular, rectangular, square or oval shape, and an inner contour with a circular, rectangular, square or oval shape.

In still another variant of the eighth component 10H, at least two strips among the first dielectric strip 28 and the other dielectric strips 72 are made from different materials.

The described eighth manufacturing process allows the simultaneous assembly of several strips 28, 72 made from different materials.

In a variant of the eighth component 10H, the waveguide 12 further comprises a functional attachment component formed by a plurality of dielectric fasteners that are integral with at least one of the strips 28, 72, each dielectric fastener extending from one of the lateral edges 36. In the manufacturing process associated with this variant, at least part of the attachment means is not removed during the assembly step.

A ninth component 10I according to the invention will now be described in light of FIG. 14.

This ninth component 10I differs from the first component 10A in that the dielectric strip 28 is not placed in the cavity 32.

The dielectric strip 28 is placed in the propagation zone 19 and is defined in the upper layer 14. The dielectric strip 28 is thus formed in the upper layer 14.

The dielectric strip 28 is formed in the central sublayer 26A of the upper layer 14 and is defined by a part of the electrically conductive upper sublayer 22A of the upper layer 14, and laterally between two upper lateral borders 78.

The dielectric strip 28 opens onto the cavity 32.

Figure 14:
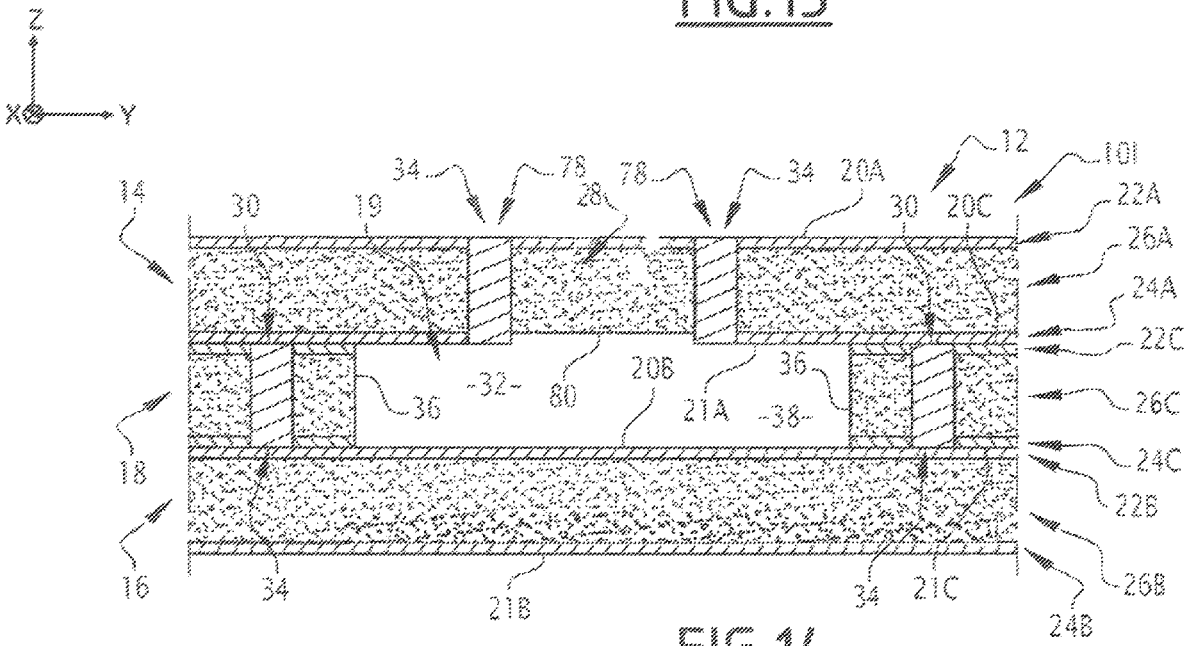

As illustrated in FIG. 14, the dielectric strip 28 has a surface 80 defining the cavity 32.

The dielectric strip 28 is placed between a plane defined by an upper surface 20C of the central layer 18 and a plane defined by an upper surface 20A of the upper layer 14.

The upper layer 14 is devoid of lower sublayer 24A, in at least a part of the upper layer 14 between the two upper lateral borders 78. In particular, in the example illustrated in FIG. 14, the upper layer 14 is completely devoid of lower sublayer 24A, between the two upper lateral borders 78.

The dielectric strip 28 here is placed in the propagation zone 19 such that, projected on the upper surface 20B of the lower layer 16, the dielectric strip 28 is separated from the lateral edges 36 of the cavity 32.

Like in the first component 10A, the propagation zone 19 is defined by the electrically conductive upper sublayer 22B of the lower layer 16 and the two central lateral borders 30 each arranged in the central layer and spaced apart from one another. Furthermore, in the ninth component 10I, the propagation zone 19 is defined by the part of the upper sublayer 22A of the upper layer 14 extending above the dielectric strip 28, by a part of the electrically conductive lower sublayer 24A of the upper layer 14, and by the upper lateral borders 78, the upper lateral borders 78 joining the parts.

The upper lateral borders 78 are able to prevent the passage of an electromagnetic wave having a wavelength greater than or equal to the minimum predetermined wavelength.

The upper lateral borders 78 are each arranged in the upper layer 14.

The upper lateral borders 78 extend parallel to the propagation axis X-X and here are parallel to one another.

The upper lateral borders 78 in particular extend over the entire thickness of the upper layer 14.

The upper lateral borders 78 are spaced apart from one another.

Here, the upper lateral borders 78 are in particular symmetrical to one another relative to the median plane of the lateral edges 36. The dielectric strip 28 here is thus centered on the median plane of the lateral edges 36.

A cross-section of the propagation zone 19 is substantially in the shape of an upside-down T.

In the example illustrated in FIG. 14, projected on the upper surface 20B of the lower layer 16, the upper lateral borders 78 are positioned separated from and between the lateral edges 36.

Each upper lateral border 78 electrically connects the lower sublayer 24A of the upper layer 14 and the upper sublayer 22A of the upper layer 14 to one another.

The upper lateral borders 78 and the central lateral borders 30 electrically connect the upper sublayer 22B of the lower layer 16 to the upper sublayer 22A of the upper layer 14, respectively on either side of the cavity 32.

In the embodiment of FIG. 14, each upper lateral border 78 comprises a row of electrically conductive vias 34, arranged through the upper layer 14. More specifically, each via 34 extends along the direction Z-Z, while passing through the upper layer 14.

Each via 34 electrically connects the lower sublayer 24A of the upper layer 14 and the upper sublayer 22A of the upper layer 14 to one another.

The separation between two successive vias 34 of an upper lateral border 78 is smaller than the predetermined minimum wavelength, in particular smaller than one tenth of the predetermined minimum wavelength, preferably smaller than one twentieth of the predetermined minimum wavelength.

A ninth manufacturing process relative to the manufacturing of the ninth component 10I will now be described.

The ninth process differs from the first process in that the dielectric strip 28 is not cut in the central layer 18 and is not placed in the cavity 32.

Furthermore, no attachment means as described in the first process is cut in the central layer 18. In this embodiment, no fastener is used compared to the embodiments making it possible to place the dielectric strip 28 in the cavity 32.

The central layer 18 is provided while having a recess 44 intended by itself to form the cavity 32.

The provision of the upper layer 14 comprises providing an initial upper layer, the initial upper layer being intended to form the upper layer 14.

The initial upper layer thus comprises at least one initial dielectric sublayer, intended to form the central sublayer 26A of the upper layer 14, an electrically conductive upper sublayer, intended to form the upper sublayer 22A of the upper layer 14, and an electrically conductive lower sublayer, intended to form the lower sublayer 24A of the upper layer 14.

In the ninth process, the step for providing the upper layer 14 comprises producing the dielectric strip 28. The production of the dielectric strip 28 comprises implementing upper lateral borders 78 and eliminating at least part, advantageously all, of the electrically conductive lower sublayer of the initial upper layer extending between the two upper lateral borders 78.

The part of the central dielectric sublayer of the initial upper layer defined between the upper lateral borders 78 forms the dielectric strip 28.

At the end of the step for producing the dielectric strip 28, the initial upper layer forms the upper layer 14.

During the assembly, the central layer 18 is fastened to the lower layer 16 and the upper layer 14 is fastened to the central layer 18 in order to form the ninth component 10I.

Thus, after assembly, the propagation zone 19 comprises the dielectric strip 28 delimited in the upper layer 14, the dielectric strip 28 having a surface defining the cavity 32.

In a variant, not shown, of the ninth component 10I, the dielectric strip 28 is defined in the lower layer 16. In the associated manufacturing process, the step for providing the lower layer 16 comprises producing the dielectric strip 28.

In a variant, not shown, of the ninth component 10I, the dielectric strip 28 is not centered on the median plane of the lateral edges 36. In particular, the dielectric strip 28 is laterally offset relative to the median plane of the lateral edges 36.

The upper lateral borders 78 are then devoid of symmetry relative to the median plane of the lateral edges 36.

A tenth component 10J according to the invention will now be described in light of FIG. 15.

This tenth component 10J differs from the ninth component 10I in that the dielectric strip 28 is a first dielectric strip 28.

The waveguide 12 further comprises a second dielectric strip 72 placed in the propagation zone 19 and defined in the lower layer 16, separated from the first dielectric strip 28.

The second dielectric strip 72 is thus formed in the lower layer 16, in particular separated from the first dielectric strip 28.

The second dielectric strip 72 is formed in the central sublayer 26B of the lower layer 16 and is defined by a part of the electrically conductive lower sublayer 24B of the lower layer 16, and laterally between two lower lateral borders 82.

The second dielectric strip 72 opens onto the cavity 32.

Figure 15:
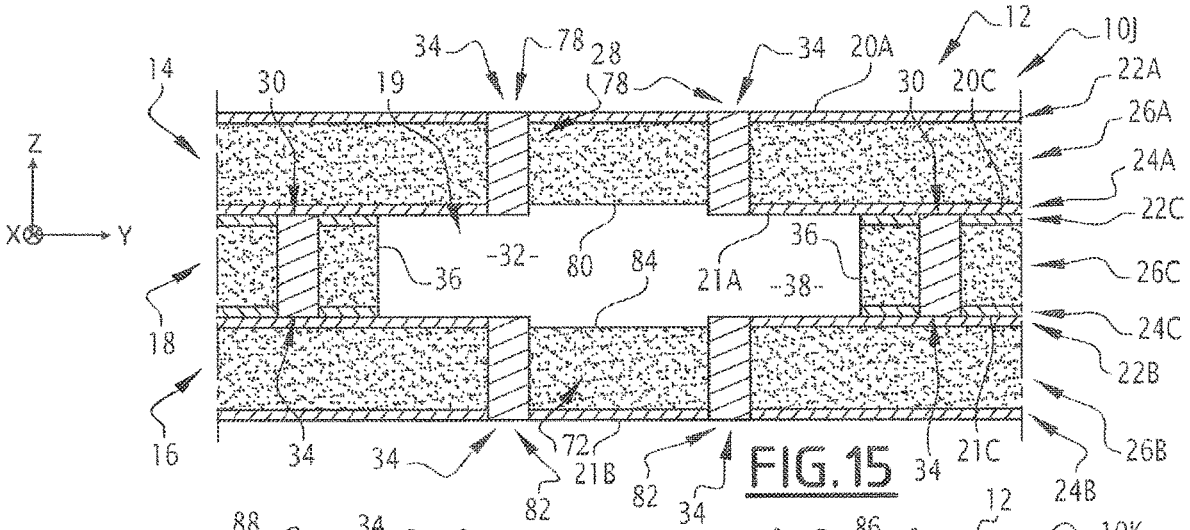

As illustrated in FIG. 15, the second dielectric strip 72 has a surface 84 defining the cavity 32.

The second dielectric strip 72 is placed between a plane defined by a lower surface 21C of the central layer 18 and a plane defined by a lower surface 21B of the lower layer 16.

The lower layer 16 is devoid of upper sublayer 22B, in at least a part of the lower layer 16 between the two lower lateral borders 82. In particular, in the example illustrated in FIG. 15, the lower layer 16 is completely devoid of upper sublayer 22B, between the two lower lateral borders 82.

The second dielectric strip 72 is placed in the propagation zone 19, such that, projected on the upper surface 20B of the lower layer 16, the second dielectric strip 72 is separated from the lateral edges 36 of the cavity 32.

Like in the ninth component 10I, the propagation zone 19 is defined by a part of the electrically conductive lower sublayer 24A of the upper layer 14, a part of the electrically conductive upper sublayer 22A of the upper layer 14, and the upper lateral borders 78 joining the parts. The propagation zone 19 is also laterally defined by the two central lateral borders 30 each arranged in the central layer 18 and spaced apart from one another.

Furthermore, in the tenth component 10J, the propagation zone 19 is defined by the part of the electrically conductive lower sublayer 24B of the lower layer 16 extending below the second dielectric strip 72, by a part of the electrically conductive upper sublayer 22B of the lower layer 16, and by the lower lateral borders 82, the lower lateral borders 82 joining the parts.

The lower lateral borders 82 of the propagation area 19 are able to prevent the passage of an electromagnetic wave having a wavelength greater than or equal to the minimum predetermined wavelength.

The lower lateral borders 82 are each arranged in the lower layer 16.

The lower lateral borders 82 extend parallel to the propagation axis X-X and here are parallel to one another.

The lower lateral borders 82 in particular extend over the entire thickness of the lower layer 16.

The lower lateral borders 82 are spaced apart from one another.

Here, the lower lateral borders 82 are in particular symmetrical to one another relative to the median plane of the lateral edges 36. The second dielectric strip 72 here is thus centered on the median plane of the lateral edges 36.

A cross-section of the propagation zone 19 is substantially in the shape of an upside-down cross.

In particular, the lower lateral borders 82 for example here extend respectively in the extension of the upper lateral borders 78.

Furthermore, in the example illustrated in FIG. 15, projected on the upper surface 20B of the lower layer 16, the lower lateral borders 82 are positioned separated from and between the lateral edges 36.

Each lower lateral border 82 electrically connects the upper sublayer 22B of the lower layer 16 and the lower sublayer 24B of the lower layer 16 to one another.

The lower lateral borders 82, the upper lateral borders 78 and the central lateral borders 30 electrically connect the lower sublayer 24B of the lower layer 16 to the upper sublayer 22A of the upper layer 14, respectively on either side of the cavity 32.

In the embodiment of FIG. 15, each lower lateral border 82 comprises a row of electrically conductive vias 34, arranged through the lower layer 16. More specifically, each via 34 extends along the direction Z-Z, while passing through the lower layer 16.

Each via 34 electrically connects the upper sublayer 22B of the lower layer 16 and the lower sublayer 24B of the lower layer 16 to one another.

The separation between two successive vias 34 of a lower lateral border 82 is smaller than the predetermined minimum wavelength, in particular smaller than one tenth of the predetermined minimum wavelength, preferably smaller than one twentieth of the predetermined minimum wavelength.

A tenth process relative to the manufacturing of the tenth component 10J will now be described.

The tenth process differs from the ninth process in that the described step for producing the dielectric strip 28 corresponds to the production of the first dielectric strip 28.

In the tenth process, the step for providing the lower layer 16 comprises producing the second dielectric strip 72.

The provision of the lower layer 16 comprises providing an initial lower layer, the initial lower layer being intended to form the lower layer 16.

The initial lower layer thus comprises at least one initial dielectric sublayer, intended to form the central sublayer 26B of the lower layer 16, an electrically conductive upper sublayer, intended to form the lower sublayer 22B of the upper layer 16, and an electrically conductive lower sublayer, intended to form the lower sublayer 24B of the lower layer 16.

The production of the second dielectric strip 72 comprises implementing lower lateral borders 82 and eliminating at least part, advantageously all, of the electrically conductive upper sublayer of the initial lower layer extending between the two lower lateral borders 82.

The part of the central dielectric sublayer of the initial lower layer defined between the lower lateral borders 82 forms the second dielectric strip 72.

At the end of the step for producing the second dielectric strip 72, the initial lower layer forms the lower layer 16.

During the assembly, the central layer 18 is fastened to the lower layer 16 and the upper layer 14 is fastened to the central layer 18 in order to form the tenth component 10J.

Thus, after assembly, the propagation zone 19 comprises a second dielectric strip 72 defined in the lower layer 16, the second dielectric strip 72 being separated from the first dielectric strip 28.

In a variant of the tenth component 10J, the second dielectric strip 72 is not centered on the median plane of the lateral edges 36. In particular, the second dielectric strip 72 is laterally offset relative to the median plane of the lateral edges 36.

The lower lateral borders 82 are then devoid of symmetry relative to the median plane of the lateral edges 36.

A eleventh component 10K according to the invention will now be described in light of FIG. 16.

The eleventh component 10K differs from the ninth component 10I in that the dielectric strip 28 is a first dielectric strip 28.

The waveguide 12 further comprises a second dielectric strip 72 placed in the propagation zone 19 and defined in the upper layer 14, separated from the first dielectric strip 28.

The second dielectric strip 72 is thus formed in the upper layer 14, in particular separated from the first dielectric strip 28.

The first dielectric strip 28 and the second dielectric strip 72 are each formed in the central sublayer 26A of the upper layer 14 and are respectively defined by a part of the electrically conductive upper sublayer 22A of the upper layer 14, and laterally between an inner upper lateral border 86 and an outer upper lateral border 88.

The first dielectric strip 28 and the second dielectric strip 72 each open at least partially onto the cavity 32.

Figure 16:
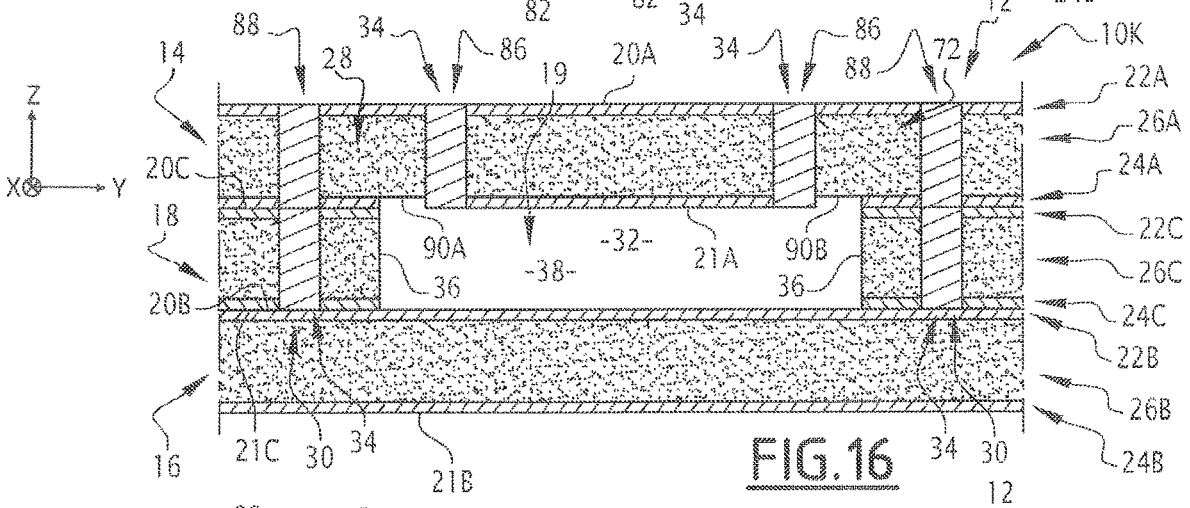

As illustrated in FIG. 16, the first dielectric strip 28 and the second dielectric strip 72 each have a surface 90A, 90B defining the cavity 32.

Between an inner upper lateral border 86 and the outer upper lateral border 88 that is adjacent thereto, the upper layer 14 is devoid of lower sublayer 24A, in at least part of the upper layer 14. "An inner upper lateral border and the outer upper lateral border that is adjacent thereto" means that no inner upper lateral border 86 is intermediate between the borders.

Like in the first component 10A, the propagation zone 19 is defined by the electrically conductive upper sublayer 22B of the lower layer 16 and the two central lateral borders 30 each arranged in the central layer 18 and spaced apart from one another.

Furthermore, in the eleventh component 10K, the propagation zone 19 is defined by the part of the upper sublayer 22A of the upper layer 14 extending above the first dielectric strip 28 and the second dielectric strip 72, by a part of the electrically conductive lower sublayer 24A of the upper layer 14, and by the inner upper lateral borders 86 and by the outer upper lateral borders 88, the inner upper lateral borders 86 and outer upper lateral borders 88 joining the parts.

The inner upper lateral borders 86 and outer upper lateral borders 88 are able to prevent the passage of an electromagnetic wave having a wavelength greater than or equal to the minimum predetermined wavelength.

The inner upper lateral borders 86 and outer upper lateral borders 88 are each arranged in the upper layer 14.

The inner upper lateral borders 86 and outer upper lateral borders 88 extend parallel to the propagation axis X-X and here are parallel to one another.

The inner upper lateral borders 86 and the outer upper lateral borders 88 in particular extend over the entire thickness of the upper layer 14.

The inner upper lateral borders 86 and outer upper lateral borders 88 are spaced apart from one another.

The inner upper lateral borders 86 and outer upper lateral borders 88 respectively electrically connect the lower sublayer 24A of the upper layer 14 and the upper sublayer 22A of the upper layer 14 to one another.

The outer upper lateral borders 88 and the central lateral borders 30 electrically connect the upper sublayer 22B of the lower layer 16 to the upper sublayer 22A of the upper layer 14, respectively on either side of the cavity 32.

In the example illustrated in FIG. 16, the outer upper lateral borders 88 are respectively placed in the extension of the central lateral borders 30. In a variant, the outer upper lateral borders 88 are laterally offset relative to the central lateral borders 30.

Here, the outer upper lateral borders 88 are symmetrical to one another relative to the median plane of the lateral edges 36.

The inner upper lateral borders 86 are placed between the outer upper lateral borders 88.

Here, the inner upper lateral borders 86 are symmetrical to one another relative to the median plane of the lateral edges 36.

The first dielectric strip 28 and the second dielectric strip 72 are each laterally offset relative to the median plane of the lateral edges 36.

In the example illustrated in FIG. 16, projected on the upper surface 20B of the lower layer 16, the inner upper lateral borders 86 are positioned separated from and between the lateral edges 36.

The lower sublayer 24A of the upper layer 14 electrically connects the inner upper lateral borders 86 to one another.

Between the inner upper lateral borders 86, the lower sublayer 24A of the upper layer 14 is continuous. "Continuous" means that the lower sublayer 24A of the upper layer 14 is devoid of through opening.

In the embodiment of FIG. 16, each of the inner upper lateral borders 86 and outer upper lateral borders 88 comprises a row of electrically conductive vias 34, arranged through the upper layer 14. More specifically, each via extends along the direction Z-Z, while passing through the upper layer 14.

Each via electrically connects the lower sublayer 24A of the upper layer 14 and the upper sublayer 22A of the upper layer 14 to one another.

The separation between two successive vias 34 of an inner 86 or outer 88 upper lateral border is smaller than the predetermined minimum wavelength, in particular smaller than one tenth of the predetermined minimum wavelength, preferably smaller than one twentieth of the predetermined minimum wavelength.

An eleventh process relative to the manufacturing of the eleventh component 10K will now be described.

The eleventh process differs from the ninth process in that the step for providing the upper layer 14 comprises producing the first dielectric strip 28 and producing the second dielectric strip 72.

The production step comprises implementing the inner upper lateral borders 86 and outer upper lateral borders 88 in the upper layer 14, and eliminating at least part of the electrically conductive lower sublayer of the initial upper layer extending between the inner upper lateral borders 86 and outer upper lateral borders 88 adjacent to one another.

The parts of the central dielectric sublayer of the initial upper layer defined between the adjacent inner upper lateral borders 86 and outer upper lateral borders 88 form the first dielectric strip 28 and the second dielectric strip 72.

Figure 17:
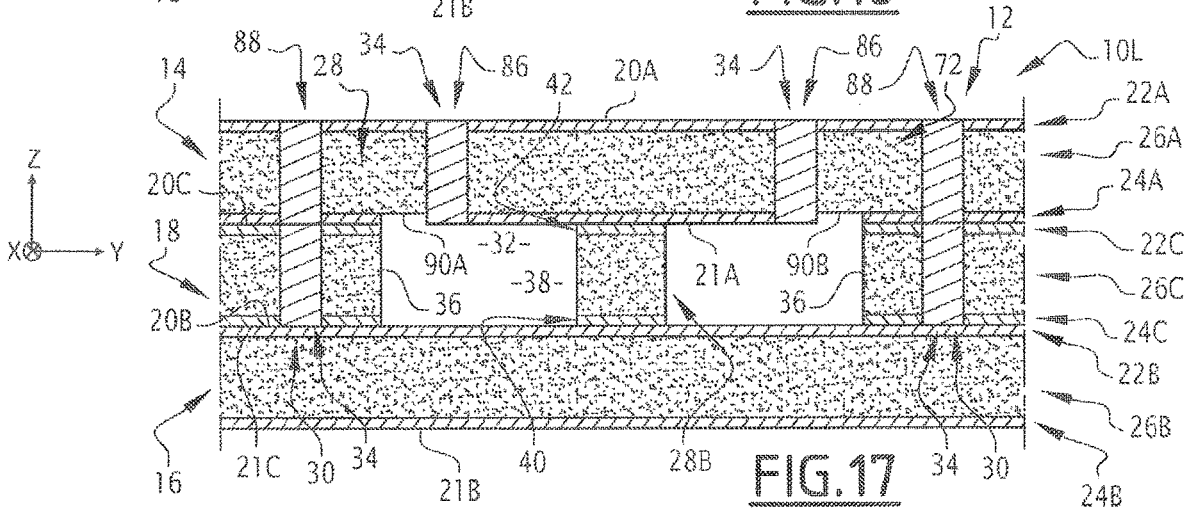

A twelfth component 10L according to the invention will now be described in light of FIG. 17.

The twelfth component 10L differs from the eleventh component 10K in that the waveguide 12 further comprises another dielectric strip 28, the other dielectric strip 28B being positioned in the cavity 32, separated from the lateral edges 36 of the cavity 32.

The other dielectric strip 28B is similar to the dielectric strip of the first component 10A.

The twelfth component 10L makes it possible to broaden the monomodal band and also to obtain interesting propagation characteristics for the radiofrequency field of application.

A twelfth process relative to the manufacturing of the twelfth component 10L will now be described.

The twelfth process differs from the eleventh process in that the twelfth process further comprises a step for producing the other dielectric strip 28B.

This step for producing the other dielectric strip 28B is substantially similar to the step for producing the dielectric strip of the first process.

The embodiments described above can be combined according to all technically possible combinations.

The invention claimed is:

1. A microwave component including a waveguide comprising an upper layer having at least one electrically conductive surface, a lower layer having at least one electrically conductive surface, and a central layer interposed between the upper layer and the lower layer, the central layer being distinct from the upper layer and from the lower layer, wherein the upper layer, the central layer and the lower layer define a zone of propagation, for an electromagnetic wave, wherein the propagation zone extending along a propagation axis, and comprising a cavity, the cavity being bounded by the upper layer, the lower layer, and, laterally, by two opposite lateral edges of the central layer, wherein the waveguide comprises a dielectric strip placed in the propagation zone, the dielectric strip being defined in one of the upper layer and the lower layer or being placed in the cavity away from the lateral edges of the central layer.

2. The component according to claim 1, wherein the dielectric strip extends along a longitudinal direction parallel to the propagation axis, and is centered on a median plane of the two lateral edges or is laterally offset from the median plane of the two lateral edges.

3. The component according to claim 1, wherein the dielectric strip is placed in the cavity, and separated from the lateral edges of the cavity, the waveguide comprising a functional attachment component, the functional attachment component being formed by a plurality of dielectric fasteners coupled to the dielectric strip, each dielectric fastener extending from one of the lateral edges, the dielectric fasteners being configured to perform a filter function for an electromagnetic wave propagating in the propagation zone.

4. The component according to claim 3, wherein each dielectric fastener is in the form of a rectilinear bar.

5. The component according to claim 1, wherein the dielectric strip is placed in the cavity and separated from the lateral edges of the central layer, the central layer comprising at least one dielectric sublayer, the cavity being defined along the propagation axis between a front end and a rear end of the central layer, the dielectric strip extending from the front end to the rear end and being integral with said dielectric sublayer of the central layer.

6. The component according to claim 1, wherein the dielectric strip is placed in the cavity and separated from the lateral edges of the central layer, the dielectric strip being a first dielectric strip, the waveguide further comprising a second dielectric strip, the second dielectric strip being placed in the cavity, separated from said first dielectric strip, and separated from the lateral edges of the central layer.

7. The component according to claim 1, wherein the dielectric strip is defined in one of the upper layer and the lower layer, the dielectric strip having a surface delimiting the cavity.

8. The component according to claim 7, wherein the dielectric strip is a first dielectric strip, the waveguide further comprising a second dielectric strip placed in the propagation zone, the second dielectric strip being delimited in one of the upper layer and the lower layer, separated from the first dielectric strip, and having a surface delimiting the cavity.

9. The component according to claim 1, wherein the waveguide further comprises another dielectric strip, the another dielectric strip being positioned in the cavity separated from the lateral edges of the cavity.

10. The component according to claim 1, wherein the cavity is filled with a fluid having a dielectric constant, or defines a sealed closed volume and is empty of fluid.

11. A process for manufacturing a microwave component comprising the following steps:

providing an upper layer and a lower layer respectively having at least one electrically conductive surface;

providing a central layer having one recess or a plurality of recesses, the recess or the plurality of recesses being defined by opposite lateral edges formed in the central layer; and assembling the upper layer, the central layer and the lower layer such that the central layer is interposed between the upper layer and the lower layer, and the central layer is distinct from the upper layer and from the lower layer;

wherein the upper layer, the central layer and the lower layer define a zone of propagation for an electromagnetic wave, the propagation zone extending along a propagation axis, and comprising a cavity, the cavity being bounded by the upper layer, the lower layer, and the lateral edges of the central layer; and wherein the method further comprises producing and placing a dielectric strip, such that after the assembling, the dielectric strip is placed in the propagation zone and is defined in one of the upper layer and the lower layer, or such that after the assembling, the dielectric strip is placed in the propagation zone and in the cavity separated from the lateral edges of the central layer.

12. The process according to claim 11, wherein providing the central layer comprises producing and placing the dielectric strip, such that after the assembling, the dielectric strip is placed in the propagation zone and in the cavity separated from the lateral edges of the cavity and is placed between a plane defined by an upper surface of the central layer and a plane defined by a lower surface of the central layer.

13. The process according to claim 12, wherein providing the central layer comprises:

providing an initial layer, the initial layer being intended to form the central layer, comprising at least one initial dielectric sublayer and being devoid of the one recess or the plurality of recesses, and cutting, in the initial layer, the one recess or the plurality of recesses, and wherein producing the dielectric strip is carried out during the cutting of the one recess or the plurality of recesses, a surface of the dielectric strip defining an area of the one cut recess or the plurality of cut recesses, the dielectric strip having a length, taken along the propagation axis, equal to the length of the cavity, taken along the propagation axis.

14. The process according to claim 12, wherein providing the central layer comprises:

providing an initial layer, the initial layer being intended to form the central layer, comprising at least one initial dielectric sublayer and being devoid of the one recess or the plurality of recesses, and cutting, in the initial layer, the one recess or the plurality of recesses, wherein producing the dielectric strip is carried out during the cutting of the one recess or the plurality of recesses, a surface of the dielectric strip and attachment means of the dielectric strip define an area of the one cut recess or the plurality of cut recesses, and wherein the attachment means comprising a plurality of dielectric fasteners coupling the dielectric strip to at least one of the lateral edges.

15. The process according to claim 14, wherein assembling the upper layer, the central layer and the lower layer comprises attaching the central layer to the lower layer, and removing the attachment means, by cutting the attachment means, once the central layer is attached to the lower layer.

16. The process according to claim 12, wherein producing the dielectric strip comprises providing the dielectric strip and attachment means of the dielectric strip, the attachment means comprising a plurality of dielectric fasteners secured to the dielectric strip, the dielectric strip and the attachment means being provided separated from the central layer.

17. The process according to claim 11, wherein providing one of the upper layer and the lower layer comprises producing and placing the dielectric strip, such that after the assembling, the dielectric strip is placed in the propagation zone and is defined in the upper layer or the lower layer.

18. A microwave component including a waveguide comprising an upper layer having at least one electrically conductive surface, a lower layer having at least one electrically conductive surface, and a central layer interposed between the upper layer and the lower layer, the central layer being distinct from the upper layer and from the lower layer, wherein each of the upper layer, the lower layer and the central layer comprises an electrically conductive upper sublayer, an electrically conductive lower sublayer, and a dielectric central sublayer interposed between the electrically conductive upper sublayer and the electrically conductive lower sublayer;

wherein the upper layer, the central layer, and the lower layer define a zone of propagation for an electromagnetic wave, wherein the propagation zone extends along a propagation axis, and comprises a cavity, the cavity being bounded by the upper layer, the lower layer, and, laterally, by two opposite lateral edges of the central layer, wherein the waveguide comprises at least one dielectric strip placed in the propagation zone, the at least one dielectric strip being defined in one of the upper layer and the lower layer or being placed in the cavity away from the lateral edges of the central layer.

* * * * *